US009972480B2

(12) United States Patent
Ristroph

(10) Patent No.: US 9,972,480 B2
(45) Date of Patent: May 15, 2018

(54) PULSED ION GUIDES FOR MASS SPECTROMETERS AND RELATED METHODS

(71) Applicant: Agilent Technologies, Inc., Santa Clara, CA (US)

(72) Inventor: Trygve Ristroph, Fremont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days. days.

(21) Appl. No.: 14/952,012

(22) Filed: Nov. 25, 2015

(65) Prior Publication Data

US 2016/0225598 A1 Aug. 4, 2016

Related U.S. Application Data

(60) Provisional application No. 62/110,163, filed on Jan. 30, 2015.

(51) Int. Cl.
*H01J 49/06* (2006.01)

(52) U.S. Cl.
CPC ..... *H01J 49/063* (2013.01); *H01J 49/062* (2013.01)

(58) Field of Classification Search
CPC ..... H01J 49/062; H01J 49/065; H01J 49/063; H01J 49/066; H01J 49/429
See application file for complete search history.

(56) References Cited

U.S. PATENT DOCUMENTS 5,572,035 A 11/1996 Franzen
6,020,586 A 2/2000 Dresch et al.
6,504,148 B1 1/2003 Hager
6,960,760 B2 * 11/2005 Bateman ..... H01J 49/062 250/281
7,405,401 B2 * 7/2008 Hoyes ..... H01J 49/427 250/281
7,582,864 B2 9/2009 Verentchikov
8,222,597 B2 * 7/2012 Kim ..... H01J 49/066 250/292
8,299,443 B1 10/2012 Shvartsburg et al.
8,481,963 B2 7/2013 Loucks, Jr. et al.
8,835,839 B1 * 9/2014 Anderson ..... H01J 49/06 250/290

(Continued)

OTHER PUBLICATIONS

Chernushevich, I.V.; Duty cycle improvement for a quadrupole-time-of-flight mass spectrometer and its use for precursor ion scans; IM Publications 2000, vol. 6, pp. 471-479.
Hashimoto Yuichiro et al.; Duty cycle enhancement of an orthogonal acceleration TOF spectrometer using an axially-resonant excitation linear ion trap; American society for mass spectrometry; 2006; vol. 17, pp. 1669-1674.
Loboda, A.V. et al.; A novel ion trap that enables high duty cycle and wide m/z range on an orthogonal injection TOF mass spectrometer; American society for mass spectrometry; 2009; vol. 20, pp. 1342-1348.
Webb, I.A. et al.; Experimental evaluation and optimization of structures for lossless ion manipulations for ion mobility spectrometry with time-of-flight mass spectrometry; Anal Chem; 2014, vol. 86, pp. 9169-9176.

*Primary Examiner* — Wyatt Stoffa

(57) ABSTRACT

An ion guide generates a radio frequency (RF) field to radially confine ions to an ion beam along a guide axis as the ions are transmitted through the ion guide. The effective potential of the RF field includes an alternating series of barriers and wells. Ions may be trapped in individual wells in mass-dependent order, with larger masses trapped closer to a guide exit than smaller masses. The RF field may be scanned so as to release the ions from the ion guide in mass-dependent order, with larger masses released before smaller masses. The operating conditions may be set such that ions over the entire mass range arrive at a desired downstream focal point simultaneously, for example at an accelerator of a time-of-flight analyzer.

20 Claims, 14 Drawing Sheets

(56) References Cited

U.S. PATENT DOCUMENTS

| | | | | |
|---|---|---|---|---|
| 8,859,961 | B2 * | 10/2014 | Perelman | H01J 49/067 250/281 |
| 2009/0173880 | A1 * | 7/2009 | Bateman | H01J 49/065 250/292 |
| 2010/0282957 | A1 * | 11/2010 | Wouters | H01J 49/4265 250/252.1 |
| 2011/0309244 | A1 * | 12/2011 | Whitehouse | H01J 49/063 250/287 |
| 2012/0261570 | A1 * | 10/2012 | Shvartsburg | H01J 49/0018 250/287 |
| 2013/0099110 | A1 * | 4/2013 | Hoyes | H01J 49/065 250/282 |
| 2013/0175440 | A1 * | 7/2013 | Perelman | H01J 49/067 250/288 |
| 2013/0267037 | A1 * | 10/2013 | Green | H01J 49/065 436/173 |
| 2014/0084156 | A1 * | 3/2014 | Ristroph | H01J 49/062 250/290 |
| 2014/0158878 | A1 * | 6/2014 | Green | H01J 49/065 250/282 |
| 2015/0260683 | A1 * | 9/2015 | Bateman | G01N 27/622 250/282 |
| 2016/0163526 | A1 * | 6/2016 | Green | H01J 49/065 250/287 |

* cited by examiner

PULSED ION GUIDES FOR MASS SPECTROMETERS AND RELATED METHODS

RELATED APPLICATIONS

This application claims the benefit of U.S. Provisional Patent Application Ser. No. 62/110,163, filed Jan. 30, 2015, titled "PULSED ION GUIDES FOR MASS SPECTROMETERS AND RELATED METHODS," the content of which is incorporated by reference herein in its entirety.

TECHNICAL FIELD

The present invention relates to ion guides such as may be utilized in mass spectrometry.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios. Mass spectrometers are commonly used to determine the chemical composition of mixtures by precise measurement of the mass-to-charge ratio of the constituent molecular ions.

An ion guide is an example of an ion processing device that is often positioned in the process flow between the ion source and the mass analyzer. An ion guide may serve to transport ions through one or more pressure-reducing stages that successively lower the gas pressure down to the very low operating pressure (high vacuum) of the analyzer portion of the system. For this purpose, the ion guide includes multiple electrodes that receive power from a radio frequency (RF) power source. The ion guide electrodes are arranged so as to bound an interior (volume) that extends along a central axis from an ion entrance to an ion exit, and has a cross-section in the plane transverse to the axis. The ion guide electrodes are further arranged so as to generate an RF electric field that limits the excursions of the ions in radial directions (in the transverse plane). By this configuration, the ions are focused as an ion beam along the central axis of the ion guide and are transported through the ion guide with minimal loss of ions.

The interior of an ion guide may be filled with a gas such that the ion guide operates at a relatively high (yet still sub-atmospheric) pressure. For example, a gas filled ion guide may be positioned just downstream of the ion source to collect the as-produced ions with as few ion losses as possible. Also, a buffer gas may be introduced into an ion guide under conditions intended to thermalize (reduce the kinetic energy of) the ions, or to fragment the ions by collision induced dissociation (CID). Some ion guides are structured so as to define a converging ion guide volume. The RF field applied by the converging geometry can compress the ion beam and increase the efficiency of ion transmission through the ion guide exit. The large beam acceptance provided by the entrance of the converging ion guide can improve ion capture, and the comparatively small beam emittance at the exit can improve ion transfer into a succeeding device and can be closely matched to the size of the inlet of the succeeding device. The converging ion guide can also operate more effectively at higher pressures than a non-converging ion guide.

One particular type of mass spectrometer is a time-of-flight mass spectrometer (TOF-MS), which utilizes a high-resolution mass analyzer (TOF analyzer) in the form of an electric field-free flight tube. An ion accelerator (or pulser) injects ions in pulses (or packets) into the flight tube. Ions of differing masses travel at different velocities through the flight tube and thus separate (spread out) according to their differing masses before arriving at the ion detector, enabling mass resolution based on time-of-flight. In a typical TOF-MS, ions travel along a drift direction through one or more gas-filled ion guides, and one or more beam-limiting apertures operating in a collision-free environment, and into the pulsed ion accelerator. In an orthogonal acceleration TOF-MS (oaTOF-MS), the ion accelerator receives the ions along the drift direction and injects the ions along an acceleration direction orthogonal to the drift direction.

Most instrument performance specifications are improved by increasing the ion transmission efficiency between the ion source and the ion detector. In absolute terms the net transmission efficiency is poor, in practice typically ranging from one part in $10^4$ to one part in $10^9$.

In the case of a TOF-MS, the inherent sources of ion loss include poor transmission through the beam-limiting apertures, the losses associated with the duty-cycle of the pulsed ion accelerator, and losses between the pulsed ion accelerator and the ion detector that are caused by the angular divergence of the ions in the TOF region (flight tube). Previous efforts have been made to improve each of these individual inefficiencies, but not necessarily simultaneously and not necessarily to the degree to which the net transmission from the gas-filled ion guide to the ion detector approaches 100% across a wide mass range. Additionally, previous efforts do not necessarily address the ion losses in high resolution TOF instruments, which have small apertures and long flight times. Lastly, known TOF-MS systems offer limited capability to mitigate the problems caused by ion-ion Coulomb repulsion in the ion guides.

Therefore, it would be desirable to minimize ion losses through all components of a TOF-MS system (or other MS system) between the ion guide and ion detector across a wide range of masses and intensities. It would also be desirable to minimize ion losses in a way that scales to high resolution TOF instruments.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion guide includes: an entrance end; an exit end spaced from the entrance end along a drift axis, wherein the ion guide has a guide length from the entrance end to the exit end; a plurality of electrodes axially spaced along the guide length, each electrode elongated along a transverse direction orthogonal to the drift axis, wherein the electrodes at least partially define a guide volume from the entrance end to the exit end; and a voltage source communicating with the electrodes and configured for: generating a radio frequency (RF) field in the guide volume effective for confining ions along the guide axis, and comprising a series of potential corrugations that successively increase in magnitude in a direction toward the exit end; and scanning an operating parameter of the RF field.

According to another embodiment, a mass spectrometer (MS) includes: an ion guide according to any of the embodiments disclosed herein; and an ion detector downstream from the ion guide.

In some embodiments, the ion guide is configured as a mass analyzer. In other embodiments, a mass analyzer is between the ion guide and the ion detector. The mass analyzer may be configured differently than the ion guide. As one non-limiting example, the mass analyzer may be a time-of-flight (TOF) analyzer.

According to another embodiment, a method for guiding ions includes: transmitting ions through an ion guide comprising an entrance end, an exit end spaced from the entrance end along a drift axis, and a plurality of electrodes at least partially defining a guide volume from the entrance end to the exit end; while transmitting the ions, applying a radio frequency (RF) voltage to the electrodes to generate an RF field in the guide volume comprising a series of potential corrugations that successively increase in magnitude in a direction toward the exit end, wherein the RF voltage has an amplitude effective for trapping the ions in the corrugations in order of mass-to-charge (m/z) ratio that increases in the direction of the exit end, such that ions of higher m/z ratio are trapped closer to the exit end; and sequentially releasing the ions through the exit end in order of higher m/z ratio to lower m/z ratio by scanning an operating parameter of the RF voltage.

According to another embodiment, a mass spectrometry system is configured for performing any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
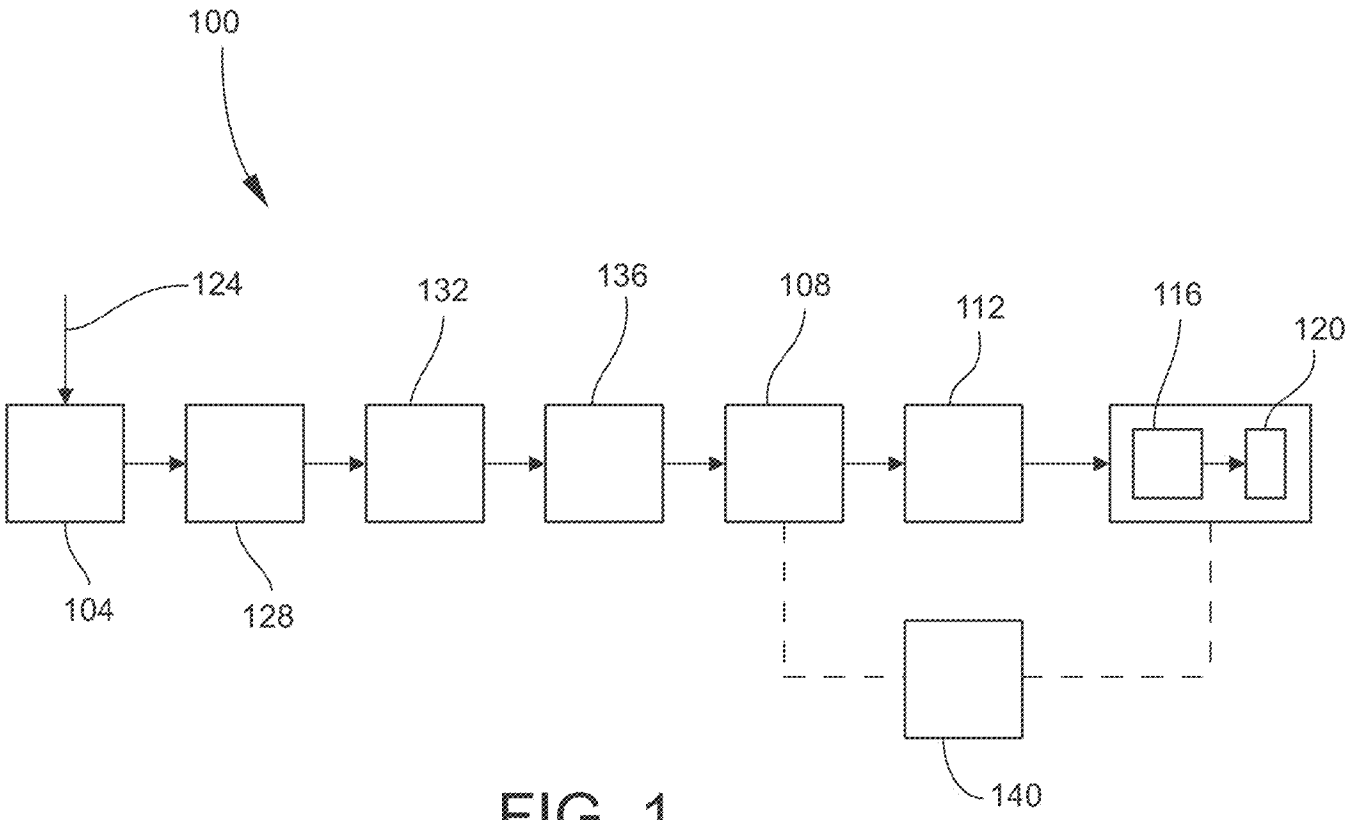
FIG. 1 is a schematic view of an example of a mass spectrometer (MS) or mass spectrometry (MS) system according to some embodiments.

FIG. 1 is a schematic view of an example of a mass spectrometer (MS) or mass spectrometry (MS) system 100 according to some embodiments, which may be utilized in the implementation of the subject matter described herein. The operation and design of various components of such MS systems are generally known to persons skilled in the art and thus need not be described in detail herein. Instead, certain components are briefly described to facilitate an understanding of the subject matter presently disclosed.

The MS system 100 may generally include, in series of ion process flow, an ion source 104, one or more ion guides 108, ion optics 112, a mass analyzer 116, and an ion detector 120. In general operation, sample molecules are introduced into the ion source 104, and the ion source 104 produces ions from sample molecules and transmits the ions to the ion guide(s) 108. The ion guide(s) 108 focus the ions as an ion beam and transmit the ions to the ion optics 112. The ion guide(s) 108 may perform additional ion processing functions such as compressing the ion beam, thermalizing (cooling) the ions, and other functions described below. The ion optics 112 transmit the ions to the mass analyzer 116. Particularly in embodiments where the mass analyzer 116 is a time-of-flight (TOF) analyzer, the ion optics 112 may provide a collision-free environment and include beam-limiting apertures that shape the ion beam. The mass analyzer 116 sorts the ions based on mass-to-charge (m/z) ratio and transmits the ions to the ion detector 120, which produces an ion signal that is then utilized to construct a mass spectrum descriptive of the sample molecules as appreciated by persons skilled in the art.

The ion source 104 may be any type of continuous-beam or pulsed ion source suitable for producing analyte ions for spectrometry. Examples of ion sources 104 include, but are not limited to, electron ionization (EI) sources, chemical ionization (CI) sources, photo-ionization (PI) sources, electrospray ionization (ESI) sources, atmospheric pressure chemical ionization (APCI) sources, atmospheric pressure photo-ionization (APPI) sources, field ionization (FI)

sources, plasma or corona discharge sources, laser desorption ionization (LDI) sources, and matrix-assisted laser desorption ionization (MALDI) sources. In some embodiments, the ion source 104 may include two or more ionization devices, which may be of the same type or different type. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is an output 124 of an analytical separation instrument such as, for example, a gas chromatography (GC) or liquid chromatography (LC) instrument (not shown).

Each ion guide 108 includes an arrangement of electrodes configured for confining ions along an axis while enabling the ions to be transmitted along the axis. For this purpose, depending on the type of ion guide radio frequency (RF) and/or direct current (DC) voltages may be applied to the ion guide electrodes. One or more of the ion guides 108 may have a converging geometry that compresses the ion beam so as to improve transmission into the next device. One or more of the ion guides 108 may be configured as a multipole structure with electrodes elongated generally along the direction of ion travel. One or more of the ion guides 108 may alternatively be configured as a straight cylindrical stacked-ring structure or an ion funnel, with ring-shaped electrodes or aperture-containing plate electrodes oriented orthogonal to the direction of ion travel. In some embodiments, at least one of the ion guides 108 has a planar geometry as described below.

The ion optics 112 may occupy an evacuated volume of a desired axial length between the ion guide(s) 108 and the entrance to the mass analyzer 116. The evacuated volume may be essentially collision-free, i.e., substantially devoid of neutral gas-phase molecules. The ion optics 112 may include one or more ion lenses arranged about an axis. An ion lens may be, as examples, a cylindrical electrode coaxial with the axis, a plate with an aperture on-axis, or pair of plates or half-cylinders separated by a gap on-axis. DC potentials may be applied to one or more of the ion lenses. One or more of the ion lenses may be configured as an ion slicer that ensures that the geometry of the ion beam matches the acceptance area of the entrance to the mass analyzer 116, and that the ion energy distribution in at least one direction transverse to the direction of ion travel is a desired low value.

In some embodiments, the mass analyzer 116 is a TOF analyzer as described further below. Aspects of the subject matter disclosed herein may also be applied to other types of mass analyzers. Examples of other types of mass analyzers include, but are not limited to, multipole electrode structures (e.g., quadrupole mass filters, linear ion traps, three-dimensional Paul traps, etc.), electrostatic traps (e.g. Kingdon, Knight and ORBITRAP® traps) and ion cyclotron resonance (ICR) traps (FT-ICR or FTMS, also known as Penning traps). The ion detector 120 may be any device configured for collecting and measuring the flux (or current) of mass-discriminated ions outputted from the mass analyzer 116. Examples of ion detectors include, but are not limited to, multi-channel detectors (e.g., micro-channel plate (MCP) detectors), electron multipliers, photomultipliers, image current detectors, and Faraday cups.

In some embodiments, the ion guide 108 is configured as a pulsed ion guide as described by examples below. In some embodiments of the MS system 100, the pulsed ion guide itself can also be used as the mass analyzer. In this embodiment, the ion detector 120 is placed close to the exit of the pulsed ion guide and the optics 112 are eliminated.

In some embodiments, the MS system 100 may also include an ion trap 128 upstream of the ion guide(s) 108. The ion trap 128 generally may have any configuration suitable for stably accumulating ions of a desired mass range for a desired period of time, and then releasing ions upon command. Various electrode geometries may be configured to operate as an ion trap and are known to persons skilled in the art, such as, for example, three-dimensional or two-dimensional multipole, stacked-ring, and ion funnel configurations.

In some embodiments, the MS system 100 may be configured for implementing tandem MS (MS/MS). For example, the MS system 100 may be configured as a QqQ, qTOF, or QqTOF instrument. Thus, the MS system 100 may include a first mass analyzer 132 upstream of the mass analyzer 116 (the second, or final mass analyzer, in such embodiments), and a collision cell 136 between the first mass analyzer 132 and the second mass analyzer 116. The first mass analyzer 132 is configured for selecting ions of a specific m/z ratio (mass) or m/z ratio range and is typically, but not necessarily, configured as a quadrupole mass filter. The collision cell 136 typically includes a non-mass-resolving, RF-only ion guide enclosed in a cell. The cell is pressurized by an inert gas to a level sufficient for producing fragment ions by collision-induced dissociation (CID) as appreciated by persons skilled in the art. However, a fragmentation device other than a CID-based device may be utilized such as, for example, a device configured for implementing electron capture dissociation (ECD), electron transfer dissociation (ETD), or infrared multiphoton dissociation (IRMPD). The second mass analyzer 116 resolves the fragment ions on the basis of m/z ratio (mass) and transmits the mass-resolved fragment ions to the ion detector 120, which outputs measurement signals from which mass spectra are then produced.

In some embodiments that include the first mass analyzer 132 and/or collision cell 136, the first mass analyzer 132 and/or collision cell 136 may be configured to provide an ion trapping function. In this case, a separate ion trap 128 may not be needed.

The MS system 100 also includes a vacuum system for maintaining various interior regions of the MS system 100 at controlled, sub-atmospheric pressure levels. As appreciated by persons skilled in the art, the vacuum system may include vacuum lines communicating with the various interior regions via vacuum ports or exhaust ports, one or more vacuum-generating pumps, and associated components. The vacuum lines may also remove residual non-analytical neutral molecules from the ion path of the MS system 100.

The MS system 100 may also include a computing device (or system controller) 140. The computing device 140 is schematically depicted as representing one or more modules (or units, or components) configured for controlling, monitoring and/or timing various functional aspects of the MS system 100 described above. One or more modules of the computing device 140 may be, or be embodied in, for example, a desktop computer, laptop computer, portable computer, tablet computer, handheld computer, mobile computing device, personal digital assistant (PDA), smartphone, etc. The computing device 140 may also schematically represent all voltage sources not specifically shown, as well as timing controllers, clocks, frequency/waveform generators and the like as needed for applying voltages to various components of the MS system 100, including the voltages applied to the ion guide(s) 108 as described below. The computing device 140 may also be configured for receiving the ion detection signals from the ion detector 120 and performing tasks relating to data acquisition and signal analysis as necessary to generate chromatograms, drift spectra, and mass (m/z ratio) spectra characterizing the sample under analysis. The computing device 140 may also be configured for providing and controlling a user interface that provides screen displays of spectrometric data and other data with which a user may interact. The computing device 140 may include one or more reading devices on or in which a tangible computer-readable (machine-readable) medium may be loaded that includes instructions for performing all or part of any of the methods disclosed herein. For all such purposes, the computing device 140 may be in signal communication with various components of the MS system 100 via wired or wireless communication links (as partially represented, for example, by dashed lines between the computing device 140 and the mass analyzing/detection section, and between the computing device 140 and the ion guide(s) 108). Also for these purposes, the computing device 140 may include one or more types of hardware, firmware and/or software, as well as one or more memories and databases.

Figure 2:
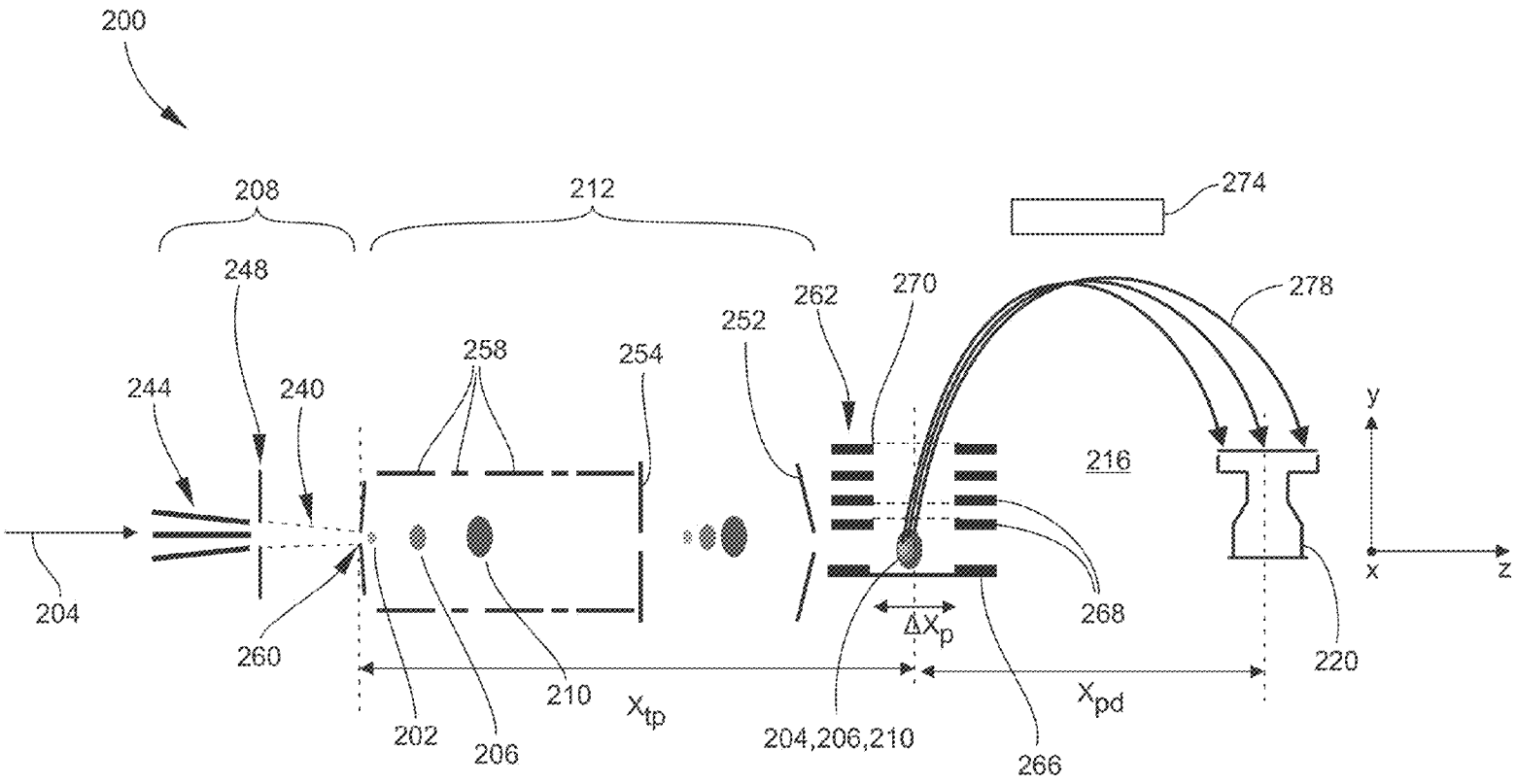
FIG. 2 is a schematic view of another example of an MS (or MS system) according to some embodiments.

FIG. 2 is a schematic view of another example of an MS (or MS system) according to some embodiments. Specifically, FIG. 2 illustrates an example of an orthogonal acceleration TOF-MS or TOF-MS system 200 according to some embodiments. For illustrative purposes, FIG. 2 includes a Cartesian coordinate frame of reference comprising a drift axis (z-axis), an acceleration axis (y-axis) orthogonal to the drift axis, and a transverse axis (x-axis) (into and out of the drawing sheet) orthogonal to the acceleration axis and to the drift axis. The acceleration axis and the transverse axis, which may both be referred to herein as "transverse" axes, lie in a transverse (x-y) plane orthogonal to the drift axis. The coordinate frame is primarily intended to show the relative orientations of the three axes; the origin (0,0,0) of the coordinate frame relative to the TOF-MS system 200 has been arbitrarily located. In the present disclosure, the term "direction" may be used interchangeably with the term "axis." The primary direction of ion travel through the TOF-MS system 200 is along the drift axis, left to right from the perspective of FIG. 2. A range of ion masses (ions of different m/z ratios) may be transmitted through the TOF-MS system 200. FIG. 2 schematically depicts this mass range as low-mass ions 202, intermediate-mass ions 206, and high-mass ions 210. In the illustrated embodiment the TOF-MS system 200 generally includes, in series along the drift axis, an ion source 204, one or more ion guides 208, ion optics 212, a TOF analyzer 216, and an ion detector 220.

The ion source 204 schematically represents a sample ionization device and all subsequent ion processing devices that may be included between the ionization device and the ion guide(s) 208. The ion guide(s) 208 include at least a pulsed ion guide 240. As described further below, the pulsed ion guide 240 is configured for accumulating a range of ion masses and sequentially releasing the ions in order of high-mass ions 210 to low-mass ions 202, i.e., high-mass ions 210 followed by intermediate-mass ions 206 followed by low-mass ions 202. The pulsed ion guide 240 may be preceded by one or more other ion guides, such as a multipole ion guide 244. The multipole ion guide 244 may be configured for implementing a stage of ion beam compression (concentration), or both ion beam compression and ion beam cooling (thermalizing), upstream of the pulsed ion guide 240. The multipole ion guide 244 may be structured as a plurality of electrodes elongated generally along the drift axis. Typically, the multipole ion guide 244 has a hexapole or higher-order electrode arrangement, although in some embodiments may have a quadrupole arrangement. As illustrated, the multipole ion guide 244 may have a converging geometry. RF or both RF and DC voltages may be applied to the multipole ion guide 244 and the pulsed ion guide 240. One or more interface lenses 248 may be positioned between the exit of the multipole ion guide 244 and the entrance of the pulsed ion guide 240. DC potential(s) may be applied to the interface lens(es) 248.

The ion optics 212 are positioned in a collision-free environment axially between the exit of the pulsed ion guide 240 and the entrance of the TOF analyzer 216. The ion optics 212 may include one or more beam-limiting apertures, i.e., ion lenses containing apertures on the drift axis (aperture lenses). In the illustrated embodiment, the ion optics 212 include a first ion lens 252 and a second ion lens 254 axially upstream from the first ion lens 252. The first ion lens 252 and second ion lens 254 may also collectively be referred to as an aperture pair 252, 254. Generally, the apertures may have any shape (rounded or polygonal). In some embodiments, the aperture of the second ion lens 254 is rectilinear and elongated along the transverse (x) axis. That is, the aperture of the second ion lens 254 is narrower along the acceleration (y) axis than along the transverse (x) axis, thereby slicing the ion beam such that the ion beam becomes generally ribbon-shaped prior to entering the TOF analyzer 216. In some embodiments, the ion optics 212 may further include transfer optics axially between the pulsed ion guide 240 and the aperture pair 252, 254. The transfer optics may include one or more lens elements such as cylindrical lens(es) 258 and an interface lens 260 between the pulsed ion guide 240 and the cylindrical lens(es) 258. DC potential(s) may be applied to one or more lens elements of the ion optics 212 as needed to keep ions moving along the drift (z) axis from the pulsed ion guide 240 to the TOF analyzer 216.

The TOF analyzer 216 includes an ion accelerator 262 leading into an evacuated flight tube (not specifically shown) that defines an electric field-free flight region. In the illustrated embodiment, the ion accelerator 262 is an orthogonal ion accelerator that receives ions along the drift (z) axis and accelerates ion packets into the flight tube along the acceleration (y) axis. For this purpose the electrodes of the ion accelerator 262 may include a repeller plate 266 (bottom electrode), acceleration grids 268 above the repeller plate 266, and a top grid or exit grid 270 above the acceleration grids 268. Ions enter the ion accelerator 262 in the region between the repeller plate 266 and the acceleration grids 268, and are accelerated into the flight tube through application of appropriate potentials to the repeller plate 266 and acceleration grids 268. In the orthogonal configuration, the flight tube is elongated along the acceleration (y) axis.

The illustrated embodiment further has a reflectron configuration in which the ion detector 220 is positioned generally at the same axial end (relative to the acceleration axis) of the flight tube as the ion accelerator 262, and spaced at a distance along the drift axis from the ion accelerator 262. FIG. 2 denotes the distance along the drift direction from the center of the ion accelerator 262 to the center of the ion detector 220 as $x_{pd}$, the length of the interior of the ion accelerator 262 along the drift direction as $\Delta x_p$, and the distance along the drift direction from the entrance of the ion optics 212 to the center of the ion accelerator 262 as $x_{tp}$. An ion mirror (or reflector) 274 is positioned at the opposite axial end (relative to the acceleration axis) of the flight tube, whereby the ion mirror 274 is spaced from both the ion accelerator 262 and the ion detector 220 along the acceleration (y) axis.

The ion mirror 274 may be a single-stage, dual-stage, or gridless reflectron. The ion mirror 274 generates a potential gradient that decelerates ions down to zero velocity in the y-component and then accelerates the ions in the opposite direction, whereby ions exit the ion mirror 274 at the same kinetic energy they had when they entered the ion mirror 274. However, for ions of the same mass (m/z ratio), faster ions entering the ion mirror 274 sooner at higher kinetic energies penetrate deeper into the ion mirror 274 before stopping and turning around to exit, in comparison to slower ions of the same mass as the faster ions. These slower ions enter the ion mirror 274 later at lower kinetic energies and do not penetrate as far into the ion mirror 274 as the faster ions before stopping and turning around to exit. Hence, the slower ions do not spend as much time in the ion mirror 274 as the faster ions of the same mass, and thus are able to catch up with the faster ions such that all slower ions and faster ions of the same mass arrive at the ion detector 220 ideally at the same time. The ion mirror 274 thus creates a reflected focal point at the location of the ion detector 220, and reduces the spread in TOF caused by the kinetic energy spread or distribution of ions of the same mass. The ion mirror 274 also increases the focal length of the TOF analyzer 216 and thus the overall flight times of the ions, which improves peak separation. FIG. 2 schematically depicts ion flight paths 278 through the flight tube with the turning points imposed by the ion mirror 274.

In operation, ions of different masses travel through the flight tube at different velocities and thus have different overall times-of-flight, i.e., ions of smaller masses travel faster than ions of larger masses. Each ion packet spreads out (is dispersed) in space in accordance with the time-of-flight distribution. The ion detector 220 detects and records the time that each ion arrives at (impacts) the ion detector 220. A data acquisition process implemented by the computing device 140 (FIG. 1) correlates the recorded times-of-flight with m/z ratios.

In a typical TOF-MS, poor efficiency in ion transmission may be associated with three different sources of ion loss. First, ion transmission through the aperture pair 252, 254 is poor, on the order of 10% for apertures which are approximately 1 mm wide and separated by approximately 100 mm, as is commonly found in instruments with a nanosecond scale pulse width near mass 1000 amu. Second, in the pulsed ion accelerator 262 the duty cycle loss depends on the ion mass, the size of the ion accelerator 262 and its distance $x_{pd}$ from the ion detector 220 measured along the drift direction. For common instrument geometries and mass ranges, the duty cycle is typically between 0.5% and 30%. Third, within the flight path in the flight tube, the angular divergence results in an ion transmission which is typically between 10% and 100% depending on the separation $x_{pd}$ between the ion accelerator 262 and the ion detector 220, the detector size, and whether or not divergent ions are refocused. Together these three sources of ion loss may result in a transmission efficiency which ranges from 0.005% to 3%. Consequently, these three areas represent an enormous opportunity for performance improvement.

In order for the aperture transmission to be high, the ion beam emanating from the gas-filled ion guide 240 preceding the aperture pair 252, 254 must have high brightness (low emittance), which is equivalent to stating that the spatial width of the confined ions must be small prior to acceleration into a beam. The ion guide 240 operates under partial vacuum, typically 5 to 50 mTorr, and the buffer gas creates a damping, or cooling, force to minimize the energy spread of the ions in the ion guide. Ideally, the ions are nearly in thermal equilibrium with the buffer gas at the point where they reach the end of the ion guide 240. For ions in thermal equilibrium with a buffer gas of fixed temperature, the beam brightness can be increased by reducing the spatial size of the confined ion beam. Therefore, it is advantageous to use an ion guide that is capable of confining the ions to small (~100 μm) length scales along the acceleration direction, such as those described in U.S. Pat. No. 8,859,961, the content of which is incorporated by reference herein. Many known configurations for ion guides do not scale favorably to small sizes for high aperture transmission.

The origin of the duty-cycle inefficiency lies in the fact that the ion accelerator 262 is inherently pulsed while the ion sources of most mass spectrometers are continuous. While it is possible to trap the ions and release all ion masses at the same time, this approach does not result in high ion transmission for all ion masses. The reason is that the ions undergo a time-of-flight separation according to their drift direction velocity in the region between the pulsed ion trap and the ion accelerator 262. In order for ions of all masses to undergo the same trajectories in the electrostatic TOF flight tube, they must all have nearly the same kinetic energy (and not the same velocity) before and after the orthogonal acceleration pulse. For a mass range where the ratio of maximum ion mass to minimum ion mass is 100, the ratio of velocities is 10, so unless the effective trap-to-accelerator distance is less than one-tenth the accelerator length, the ion packet does not fit into the ion accelerator 262 and significant mass-dependent ion losses are incurred.

According to embodiments disclosed herein, to mitigate duty cycle losses the ion guide 240 can be operated in a pulsed mode wherein heavier masses are emitted first, followed by progressively lower masses in a manner such that all masses arrive in the ion accelerator 262 simultaneously despite the difference in velocities. At the location of the ion accelerator 262, the length of the ion pulse must be smaller than the length of the ion accelerator 262 itself, typically about 25 mm. A high voltage acceleration pulse is applied when all ion masses are inside ion accelerator 262. The requirement that ions of all masses arrive simultaneously at the ion accelerator 262 and fit within it constrains both the mean time-of-release as a function of mass and the spread in the time-of-release for a single mass.

Several methods exist for realizing the mass-dependent release time. One class of methods involves mass selectively adding energy via the application of electric field to excite the ions out of a trap over a potential barrier. While successful at realizing the appropriate ejection mass as a function time, these methods suffer from reduced brightness and higher energy spread caused by the excitation process. Another method of ion release involves thermal leakage over a potential barrier instead by the addition of excitation energy. Because the thermal energy scale is much smaller than typical trap excitation energies by orders of magnitude, the resulting ion pulses from this method have a lower energy spread, a distinction which ultimately results in a significant ion transmission improvement through the apertures of the ion optics 212 and through the TOF region. To insure sufficient mass selectivity of the release time, it has been necessary that the total potential barrier include a component which is purely repulsive and derived from an alternating current (AC) field, i.e., the mass-dependent pseudo-potential contribution, as well as a component which is mass-independent derived from an attractive electrostatic (DC) potential. The magnitude of each of the two components is much larger than the thermal energy, yet the two nearly cancel one another with the AC component dominating to create a total potential repulsive barrier of approximately the thermal energy scale. The thermal leakage method has been applied to multipole ion guides with common mode RF and/or RF added to exit lenses. Other known methods that enhance duty cycle do so at the expense of brightness because the energy spread is increased beyond thermal.

To insure all ions leaving the ion accelerator 262 reach the ion detector 220 at the end of the TOF region, it is necessary to minimize the kinetic energy spread along the drift direction of the primary beam entering the ion accelerator 262, because that is what sets the angular divergence inside the TOF region. For example, in a high resolution TOF-MS without refocusing, only ions with drift-direction kinetic energy between 9.5 eV and 10.5 eV will be transmitted to the ion detector 220. So in addition to the requirements on the acceleration-direction kinetic energy spread and release time outlined above, the ion guide 240 must produce a beam with kinetic energy distribution, averaged over all masses, which is confined to within about 0.5 eV of the mean ion energy of 10 eV. To simultaneously minimize the energy spread and spread in release time for a specific mass, it is desirable to have the trapped ion cloud as small as possible along the drift direction. Embodiments disclosed herein are able to achieve this, whereas conventional techniques have not been able to do.

In summary, conventional techniques are limited with respect to bringing ion transmission through the apertures, duty cycle (associated with the pulsed ion accelerator 262), and time-of-flight regions close to 100%. Embodiments disclosed herein are able to improve the ion transmission efficiency through all the three portions of a TOF MS across a wide mass range and wide range of ion currents.

Figure 3A:
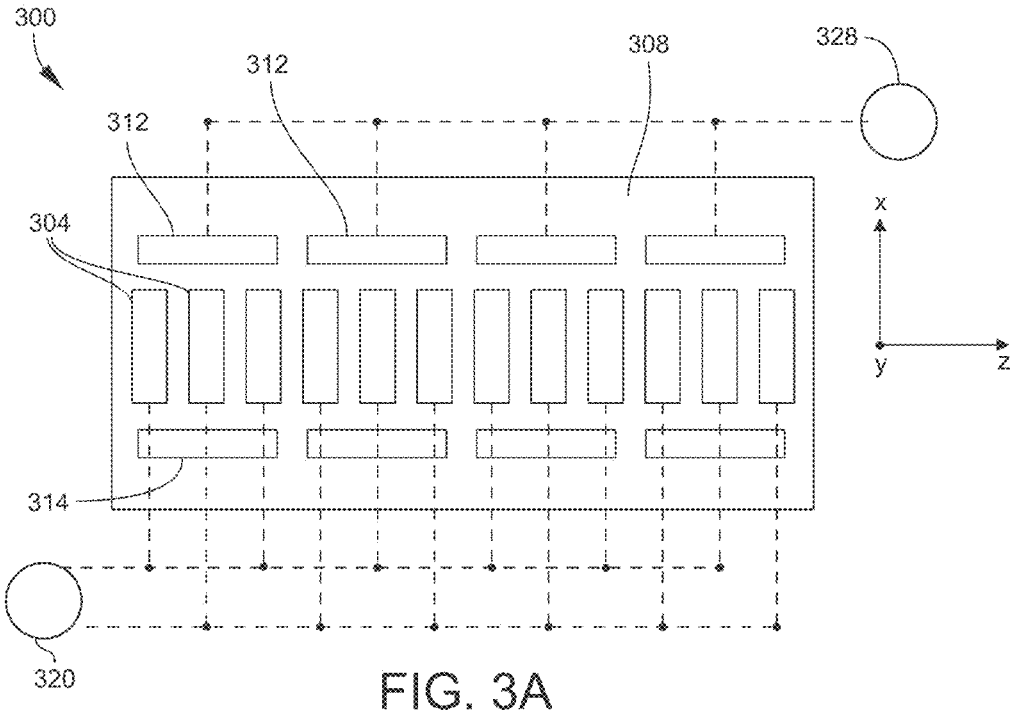
FIG. 3A is a schematic plan view (x-z plane) of an example of an electrode assembly according to some embodiments.
Figure 3B:
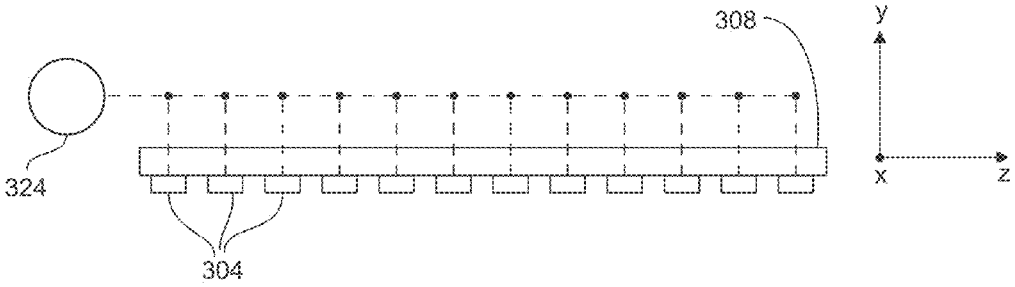
FIG. 3B is a schematic side view (y-z plane) of the electrode assembly illustrated in FIG. 3A.

FIG. 3A is a schematic plan view (x-z plane) of an example of an electrode assembly 300 according to some embodiments. FIG. 3B is a schematic side view (y-z plane) of the electrode assembly 300. Two or more electrode assemblies 300 may be utilized to construct a pulsed ion guide as described below. The electrode assembly 300 includes a plurality of transversely-oriented ion guide electrodes 304, each elongated along a transverse direction (e.g., a first transverse direction, or x-direction in the illustrated embodiment) orthogonal to the drift (z) axis, and axially spaced from each other along the drift (z) axis. The transversely-oriented ion guide electrodes 304 may also be referred to as transverse electrodes or perpendicular electrodes, as when they form a part of a pulsed ion guide they are oriented perpendicular to the main direction of ion travel, which is along the drift axis.

The transversely-oriented ion guide electrodes 304 may be fixed in position relative to each other and electrically isolated from each other by any suitable means. In some embodiments, the dimensions of the transversely-oriented ion guide electrodes 304 are small in comparison to the electrodes of conventional ion guides. For example, the transversely-oriented ion guide electrodes 304 may have features on the order of a few millimeters or micrometers. In such embodiments, the transversely-oriented ion guide electrodes 304 may be fabricated according to any microfabrication technique now known or later developed that is suitable for small dimensions, such as techniques utilized in the fields of microelectronics or micro-electro-mechanical systems (MEMS). For example, the transversely-oriented ion guide electrodes 304 may be fabricated and thereafter remain supported on a planar substrate 308 composed of (or coated with) an electrically insulating material such as, for example, various oxides, nitrides, or oxynitrides. For example, the transversely-oriented ion guide electrodes 304 may be fabricated by depositing a metallization layer on the substrate 308 by, for example, vacuum deposition or electroplating, followed by patterning by an appropriate technique entailing lithography, masking, etching, etc.

In some embodiments, the electrode assembly 300 further includes a plurality of axially-oriented ion guide electrodes 312 and 314 (or "side" electrodes, not shown in FIG. 3B) that are elongated in the drift (z) direction, and positioned at a distance from each other in the transverse (x) direction such that, along the transverse (x) direction, the transversely-oriented ion guide electrodes 304 are between the axially-oriented ion guide electrodes 312 and 314. The dimensions of the axially-oriented ion guide electrodes 312 and 314 may generally be comparable to those of the transversely-oriented ion guide electrodes 304. The axially-oriented ion guide electrodes 312 and 314 may span the entire length or a substantial portion of the length occupied by the transversely-oriented ion guide electrodes 304 in the drift direction. There may be at least one continuous-length axially-oriented ion guide electrode 312 or 314 on each side of the transversely-oriented ion guide electrodes 304. Alternatively, as illustrated, each axially-oriented ion guide electrode 312 and 314 may be segmented into two or more axially-oriented ion guide electrodes 312 and 314 along the drift direction. In some embodiments, the axially-oriented ion guide electrodes 312 and 314 are disposed on the substrate 308 in the same manner as the transversely-oriented ion guide electrodes 304.

In other embodiments, FIG. 3A may be considered as schematically depicting the edges of the axially-oriented ion guide electrodes 312 and 314. In this case, the axially-oriented ion guide electrodes 312 and 314 have lengths extending in a second transverse (y) direction (into or out of the drawing sheet) orthogonal to the drift (z) direction and the first transverse (x) direction. For example, the transversely-oriented ion guide electrodes 304 and axially-oriented ion guide electrodes 312 and 314 may be arranged in a manner similar to one or more embodiments described in above-referenced U.S. Pat. No. 8,859,961.

FIG. 3A also schematically illustrates a non-limiting example of electrical connections that may be made with the electrode assembly 300. An RF voltage source 320 (including, e.g., a waveform generator, amplifier, etc.) communicates with the transversely-oriented ion guide electrodes 304 so as to apply RF potentials of the general form $V_{RF}$ (cos $\Omega t$), where $V_{RF}$ is the amplitude of the RF potential, $\Omega=2\pi f$ is the frequency of the RF potential, and t is time. The RF voltage source 320 may be configured for applying the RF potentials such that axially adjacent electrodes 304 are driven out of phase with each other, typically by 180 degrees ($\pi$ rads). That is, the RF voltage source 320 may be configured for respectively applying first and second RF potentials $V_{RF}$ (cos $\Omega t-\varphi_1$) and $V_{RF}$ (cos $\Omega t-\varphi_2$) to alternating electrodes 304, where $\varphi_1$ and $\varphi_2$ the relative phases. In addition, a DC voltage source 324 (FIG. 3B) may communicate with one or more of the electrodes 304 so as to apply DC potentials to one or more of the electrodes 304 as desired for a particular application. In some embodiments, the DC voltage source 324 may be configured for generating an axial DC gradient along the drift axis, for example by applying a DC potential to some or all of the electrodes 304 through a resistive voltage divider network.

In addition, another DC voltage source 328 (FIG. 3A) may communicate with one or more of the axially-oriented ion guide electrodes 312 and 314 so as to apply DC potentials thereto. For simplicity, schematic connections between the DC voltage source 328 and electrodes 314 are not specifically shown. The DC voltage source 328 may be configured for focusing ions toward the drift axis and away from the electrodes 312 and 314, and/or for generating an axial DC gradient along the drift axis. When implemented in a pulsed ion guide as described below, the polarities of the DC potentials may be set as appropriate for manipulating positive or negative ions.

Figure 4A:
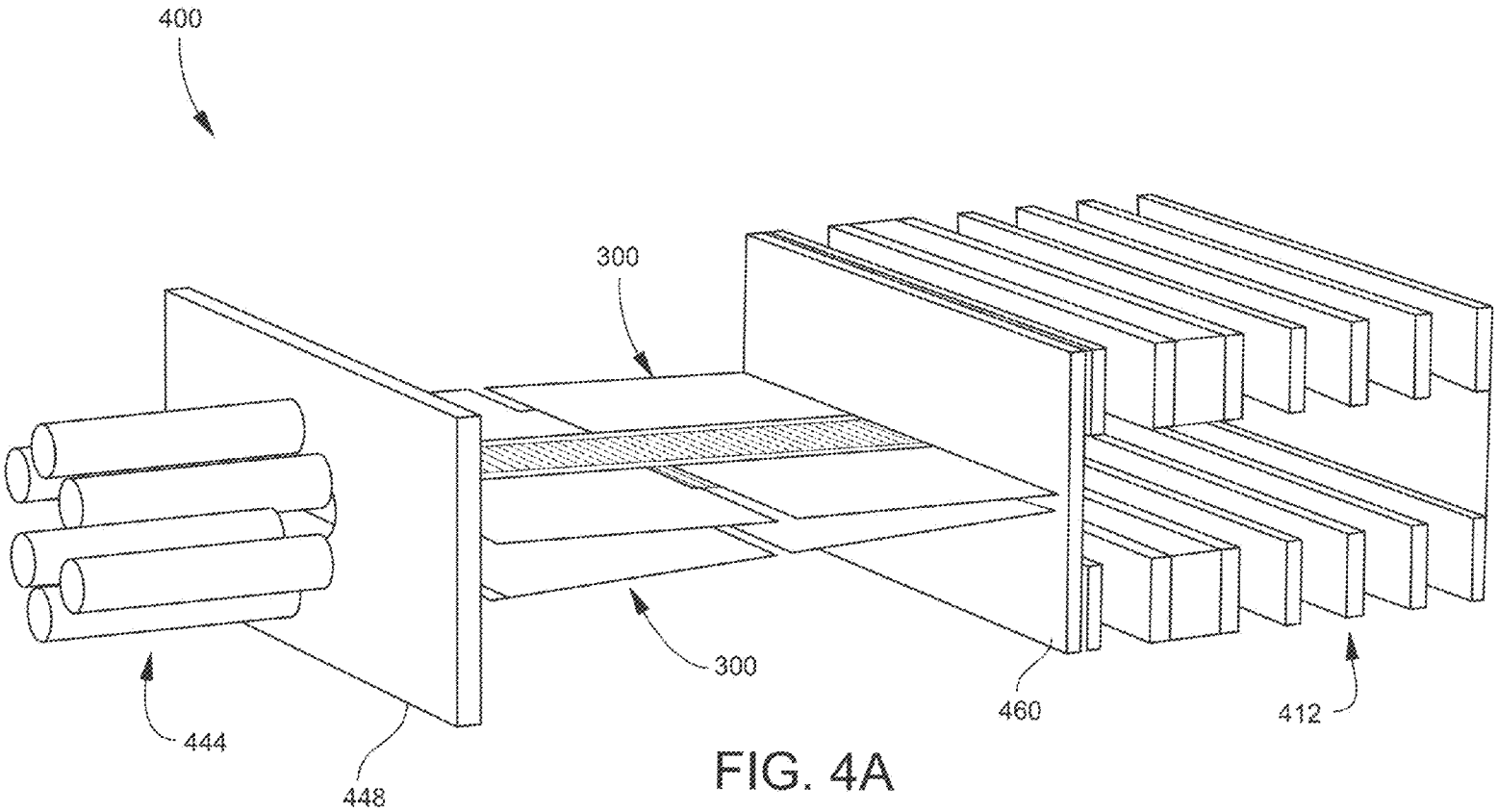
FIG. 4A is a perspective side (lengthwise) view (in the y-z plane) of an example of a pulsed ion guide according to some embodiments.
Figure 4B:
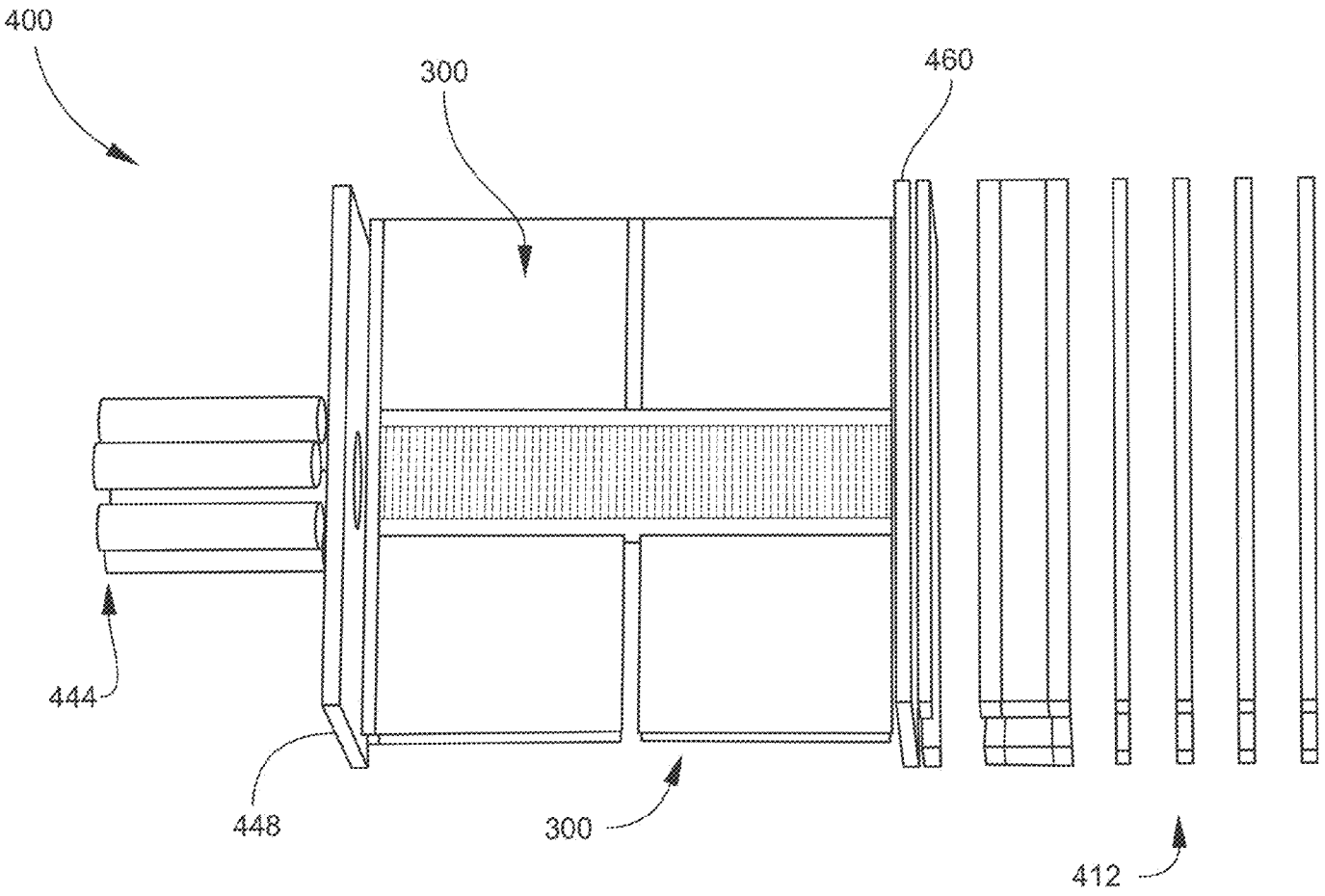
FIG. 4B is a perspective top view (in the x-z plane) of the pulsed ion guide illustrated in FIG. 4A.

FIG. 4A is a perspective side (lengthwise) view (in the y-z plane) of an example of a pulsed ion guide 400 according to some embodiments. FIG. 4B is a perspective top view (in the x-z plane) of the pulsed ion guide 400. The pulsed ion guide 400 may be utilized for example, as one of the ion guides 108 of the MS system 100 shown in FIG. 1 or the pulsed ion guide 240 of the TOF-MS system 200 shown in FIG. 2. FIGS. 4A and 4B also illustrate a multipole ion guide 444 upstream of the pulsed ion guide 400, and an interface lens 448 between the multipole ion guide 444 and the pulsed ion guide 400. FIGS. 4A and 4B also illustrate ion optics 412 downstream of the pulsed ion guide 400, and an interface lens 460 between the pulsed ion guide 400 and ion optics 412. In some embodiments, the pulsed ion guide 400 is formed by at least two electrode assemblies 300 positioned at respective distances in the second transverse (y) direction from the drift (z) axis, and arranged such that their respective sets of electrodes face each other. In some embodiments and as illustrated, the two electrode assemblies 300 may be oriented at an angle to each other such that the pulsed ion guide 400 has a converging or tapering geometry whereby the ion guide exit is smaller than the ion guide entrance in the second transverse (y) direction.

In some embodiments, the electrode assembly 300 may be modular. The electrode assembly 300 may be provided in a standard size and electrode configuration, and multiple electrode assemblies 300 may be utilized as needed to obtaining an ion guide of a desired size. As examples, a linear array of electrode assemblies 300 may be positioned along the drift axis (on both sides thereof) to extend the length of the ion guide along the drift axis, or along the first transverse (x) direction to extend the width of the ion guide along the first transverse (x) direction. As another example, a two-dimensional array of electrode assemblies 300 may be utilized to extend both the length and the width of the ion guide.

Figure 5A:
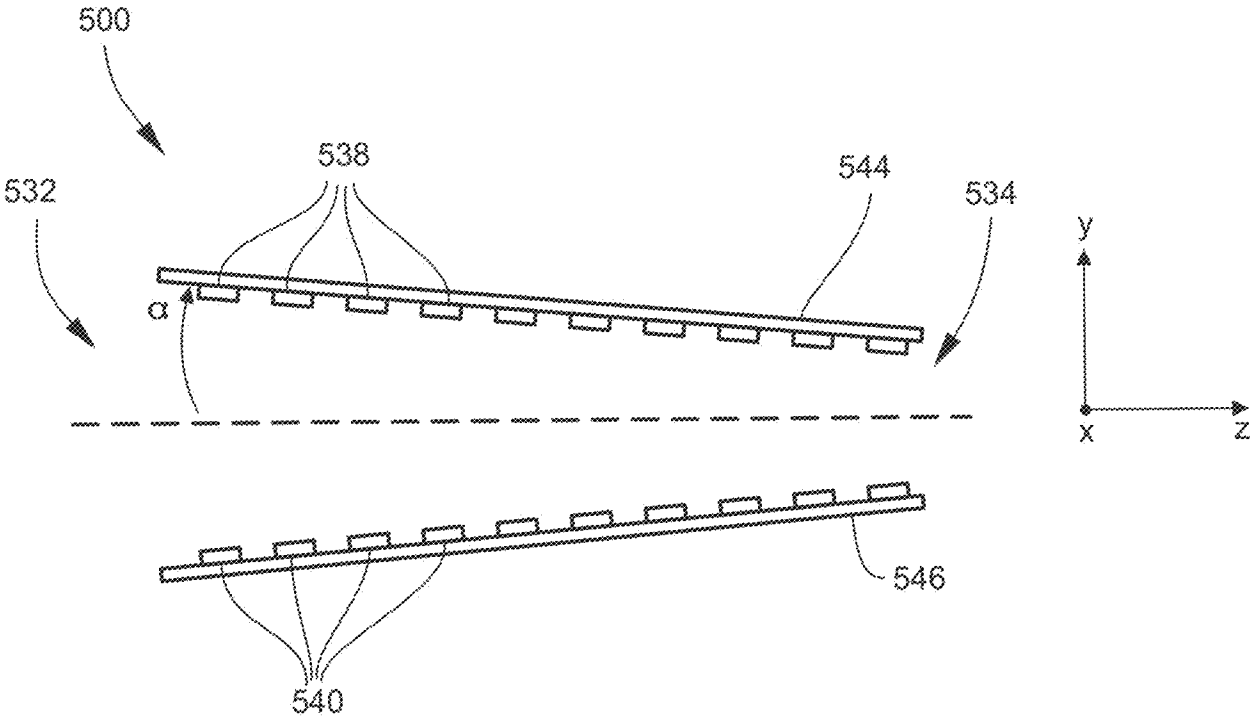
FIG. 5A is a schematic cross-sectional side (lengthwise) view (in the y-z plane) of another example of a pulsed ion guide according to some embodiments.

FIG. 5A is a schematic cross-sectional side (lengthwise) view (in the y-z plane) of another example of a pulsed ion guide 500 according to some embodiments. The ion guide 500 includes an ion entrance end 532, and an ion exit end 534 spaced from the ion entrance end 532 along the drift axis (z-axis) such that the ion guide 500 has an ion guide length from the ion entrance end 532 to the ion exit end 534 along the drift axis. The ion guide 500 further includes a plurality of ion guide electrodes axially spaced along the ion guide length. Each ion guide electrode is elongated along a transverse direction orthogonal to the drift axis, whereby the ion guide electrodes at least partially define an ion guide interior from the ion entrance end 532 to the ion exit end 534. In the illustrated embodiment, the ion guide electrodes include first ion guide electrodes 538 and second ion guide electrodes 540 elongated along a first transverse direction (x-axis). Each first electrode 538 is at a transverse distance from a corresponding second electrode 540 along a second transverse direction (acceleration axis, or y-axis) orthogonal to the first transverse direction and to the drift axis, thus forming a plurality of electrode pairs 538/540 axially spaced along the ion guide length.

In some embodiments and as illustrated, the transverse distance (in the second transverse direction) between each first electrode 538 and corresponding second electrode 540 successively decreases as one moves along the drift axis in the direction toward the ion exit end 534, such that the cross-section of the ion exit end 534 is smaller than the cross-section of the ion entrance end 532 in the second transverse direction. Hence, the ion guide volume bounded by the first electrodes 538 and second electrodes 540 converges or tapers toward the ion guide axis in the direction toward the ion exit end 534. This converging or tapering geometry may occur over the entire length of the ion guide 500 or over a portion of the length of the ion guide 500. That is, the ion guide 500 may include a converging section and a straight section (not shown) upstream and/or downstream of the converging section. In some embodiments, the converging or tapering geometry occurs in at least a downstream section of the ion guide 500 that terminates at the ion exit end 534, i.e., a downstream section extending from the ion exit end 534 toward the ion entrance end 532 (in the negative z-direction) over at least a portion of the ion guide length. In some embodiments, the converging or tapering angle $\alpha$ relative to the drift axis is in a range from 0.3 to 10 degrees.

As noted above, the ion guide 500 and first electrodes 538 and second electrodes 540 may have small dimensions as compared to conventional ion guides. In typical but not exclusive embodiments, the scale of the dimensions may be as follows: the length of the ion guide 500 along the drift axis is on the order of millimeters (mm); the length of the first electrodes 538 and second electrodes 540 along the first transverse (x) direction is on the order of millimeters; the width of the first electrodes 538 and second electrodes 540 in the drift (z) direction (or along the converging direction) is on the order of micrometers (μm); the height (or thickness) of the first electrodes 538 and second electrodes 540 in the y-direction (or in the direction orthogonal to the converging direction) is on the order of micrometers; and the pitch (distance between adjacent first electrodes 538 or adjacent second electrodes 540) is on the order of micrometers. As non-limiting examples, the length of the ion guide 300 may be in a range from 3 mm to 30 mm, the length of the first electrodes 538 and second electrodes 540 may be in a range from 0.5 mm to 5 mm, the width of the first electrodes 538 and second electrodes 540 may be in a range from 10 μm to 500 μm, the height of the first electrodes 538 and second electrodes 540 may be in a range from 0.5 μm to 5 μm, and the pitch may be in a range from 10 μm to 500 μm. In some embodiments, the width of one or more of the first electrodes 538 and second electrodes 540 may be different from the width of the other first electrodes 538 and second electrodes 540, as needed to achieve a desired effect on the electric field generated between the first electrodes 538 and second electrodes 540. As one non-limiting example, the width of the last first electrode 538 and second electrode 540 (nearest to the ion exit end 534) may be greater than the width of the other first electrodes 538 and second electrodes 540. Likewise, the pitch between one or more adjacent electrode pairs 538/540 may vary as needed to achieve a desired effect on the electric field.

Generally, the first electrodes 538 and second electrodes 540 may be mounted in fixed positions and electrically isolated from each other by any suitable techniques. In some embodiments, the first electrodes 538 and second electrodes 540 are supported on a first planar substrate 544 and a second planar substrate 546, respectively. Microfabrication techniques may be utilized as described above.

Figure 5B:
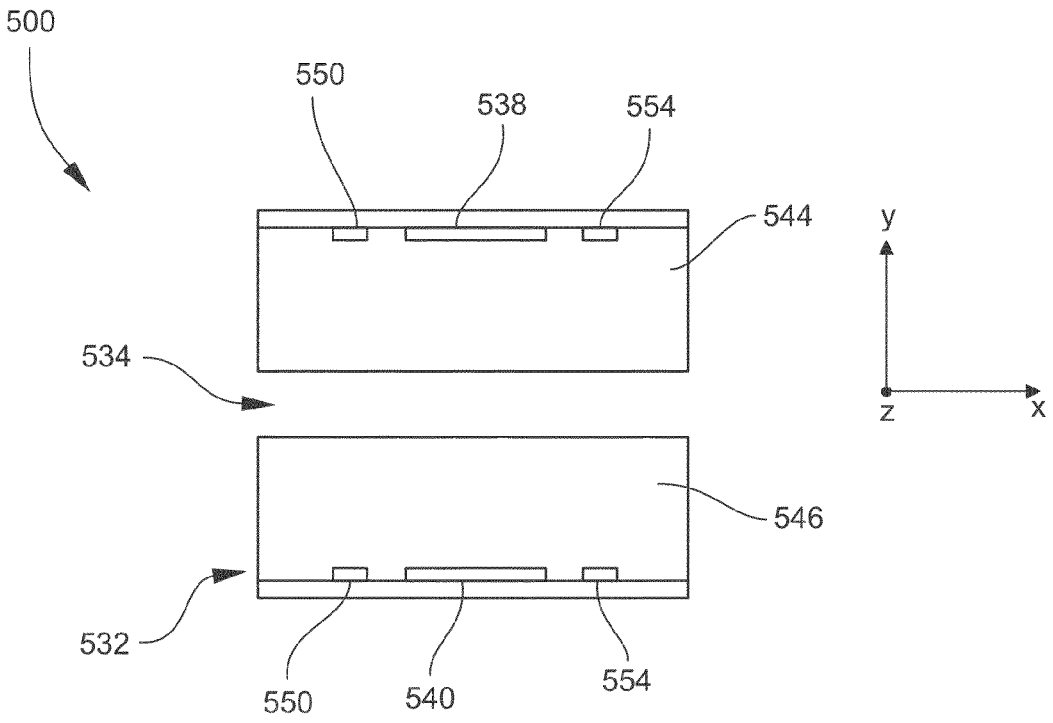
FIG. 5B is a schematic end view in the transverse (x-y) plane of the ion guide illustrated in FIG. 5A according to one embodiment.

FIG. 5B is a schematic end view in the transverse (x-y) plane of the ion guide 500 according to one embodiment. Specifically, FIG. 5B is a view of the ion entrance end 532, with the ion exit end 534 also being visible at a conceptual depth into the drawing sheet. The ion guide 500 may include third ion guide electrodes 550 positioned at a distance in the transverse (x) direction from the first electrodes 538 and second electrodes 540. The ion guide 500 may further include fourth ion guide electrodes 554 positioned at a distance in the transverse (x) direction from the first electrodes 538 and second electrodes 540. The third ion guide electrodes 550 and fourth ion guide electrodes 554 are positioned on opposite sides of the first electrodes 538 and second electrodes 540, and at a distance from each other along the transverse (x) direction. The third ion guide electrodes 550 may include at least one upper third ion guide electrode adjacent to the first electrodes 538, and at least one lower third ion guide electrode adjacent to the second electrodes 540. Likewise, fourth ion guide electrodes 554 may include at least one upper fourth ion guide electrode adjacent to the first electrodes 538, and at least one lower fourth ion guide electrode adjacent to the second electrodes 540. In the present context, the terms "upper" and "lower" are used solely in a relative sense, and thus are not intended to limit opposing "upper" and "lower" electrodes to a vertical orientation.

The third ion guide electrodes 550 and fourth ion guide electrodes 554 may span the entire length or a substantial portion of the length of the ion guide 500 occupied by the first electrodes 538 and second electrodes 540 (specifically, the length in the y-z plane along the converging direction), in either a continuous or segmented manner as described above with regard to the electrodes 312 and 314 illustrated in FIG. 3A. In some embodiments, the third ion guide electrodes 550 and fourth ion guide electrodes 554 are disposed on the first substrate 544 and second substrate 546 in the same manner as the first electrodes 538 and second electrodes 540. Thus, as illustrated, a first set of the third ion guide electrodes 550 (upper) is disposed on the first substrate 544, and a second set of the third ion guide electrodes 550 (lower) is disposed on the second substrate 546 at a distance from the first set. Likewise, a first set of the fourth ion guide electrodes 554 (upper) is disposed on the first substrate 544, and a second set of the fourth ion guide electrodes 554 (lower) is disposed on the second substrate 546 at a distance from the first set.

Figure 5C:
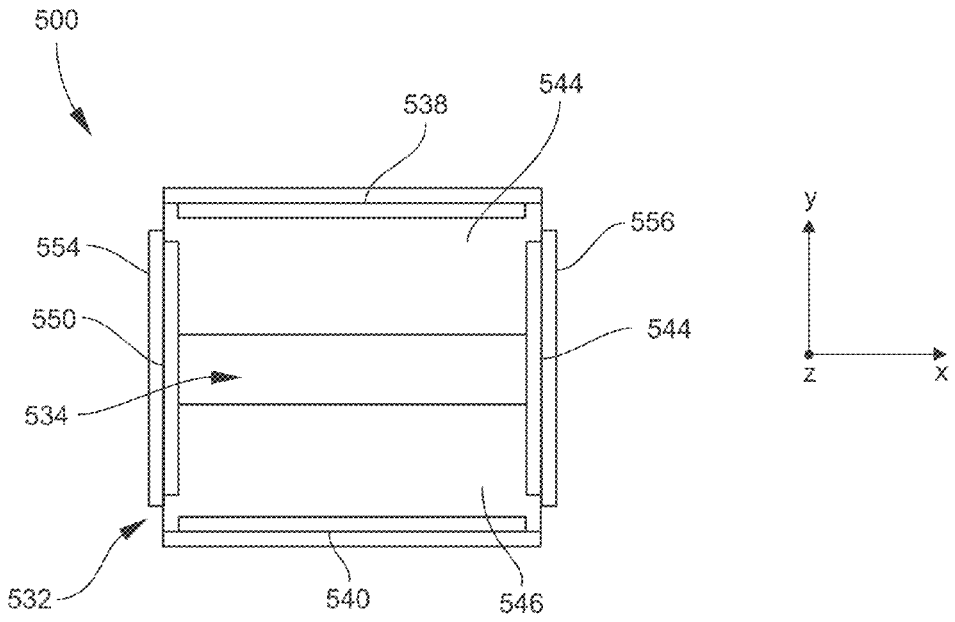
FIG. 5C is a schematic end view in the transverse (x-y) plane of the ion guide illustrated in FIG. 5A according to another embodiment.

FIG. 5C is a schematic end view in the transverse (x-y) plane of the ion guide 500 according to another embodiment. Similar to FIG. 5B, FIG. 5C is a view of the ion entrance end 532, with the ion exit end 534 also being visible at a conceptual depth into the drawing sheet. Again, the ion guide 500 includes one or more third ion guide electrodes 550 positioned at a distance in the transverse (x) direction from the first electrodes 538 and second electrodes 540, and one or more fourth ion guide electrodes 554 positioned at a distance in the transverse (x) direction from the first electrodes 538 and second electrodes 540. Also, the third ion guide electrode(s) 550 and fourth ion guide electrode(s) 554 are positioned on opposite sides of the first electrodes 538 and second electrodes 540, and at a distance from each other along the transverse (x) direction. The third ion guide electrode(s) 550 and fourth ion guide electrode(s) 554 have an elongated length generally along the drift (z) axis (i.e., into the drawing sheet), and in this embodiment have a significant width along the transverse (y) direction. In some embodiments, the first electrodes 538 and second electrodes 540 may be respectively disposed on a first substrate 544 and a second substrate 546 as described above, which may converge toward the ion guide axis as described above. In addition, the third ion guide electrode(s) 550 and fourth ion guide electrode(s) 554 may be respectively disposed on a third substrate 554 and a fourth substrate 556. The first substrate 544, second substrate 546, third substrate 554, and fourth substrate 556 may be adjoined at the corners, or separated by gaps at the corners.

In some embodiments and as illustrated, the third ion guide electrode(s) 550 and fourth ion guide electrode(s) 554 (and third substrate 554 and fourth substrate 556, if provided) may be parallel to each other. In other embodiments, the third ion guide electrode(s) 550 and fourth ion guide electrode(s) 554 (and third substrate 554 and fourth substrate 556, if provided) may converge toward each other as one moves along the drift axis in the direction toward the ion exit end 534, whereby the dimension of the ion exit end 534 along the transverse (x) direction is smaller than that of the ion entrance end 532.

Figure 5D:
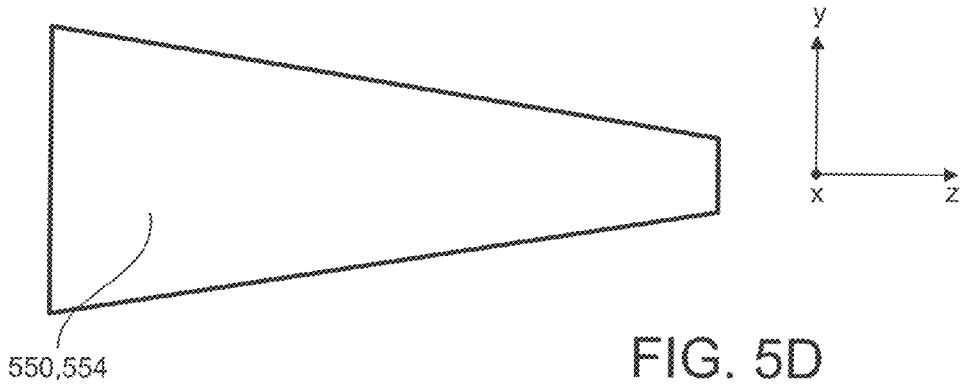
FIG. 5D is a schematic side (lengthwise) view (in the y-z plane) of an example of a side electrode according to the embodiment of FIG. 5C.
Figure 5E:
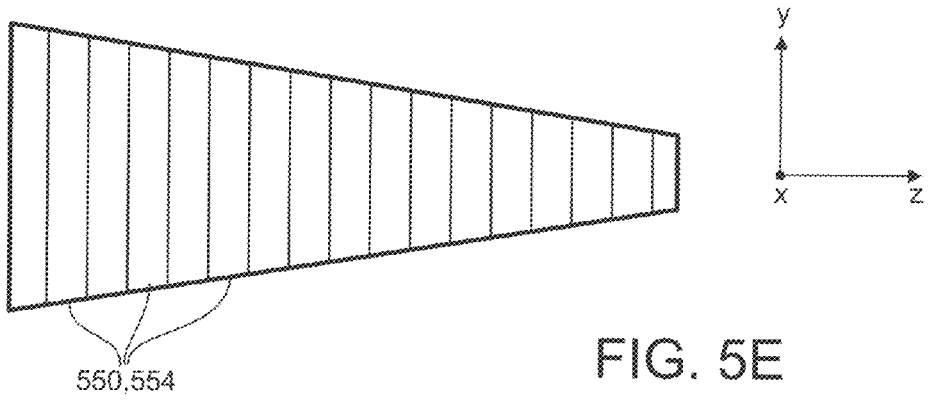
FIG. 5E is a schematic side (lengthwise) view (in the y-z plane) of another example of side electrodes according to the embodiment of FIG. 5C.

FIG. 5D is a schematic side (lengthwise) view (in the y-z plane) of an example of the third ion guide electrode 550 or the fourth ion guide electrode 554 according to the embodiment of FIG. 5C. In this embodiment, the third ion guide electrode 550 or the fourth ion guide electrode 554 is a single, continuous layer of electrically conductive material, which in some embodiments may be disposed on an underlying substrate. FIG. 5E is a schematic side (lengthwise) view (in the y-z plane) of another example of the third ion guide electrode 550 or the fourth ion guide electrode 554 according to the embodiment of FIG. 5C. In this embodiment, the third ion guide electrode 550 or the fourth ion guide electrode 554 comprises a plurality of third ion guide electrodes 550 or fourth ion guide electrodes 554 axially spaced from each other along the drift (z) axis, each of which may be individually addressable by a voltage source.

Thus, it is seen that in some embodiments the structure of the ion guide is "open" at the lateral sides (y-z plane) as shown in FIGS. 4A, 4B and 5B, while in other embodiments is "closed" as shown in FIGS. 5C, 5D and 5E.

As described above, the ion guide 500 may include RF or both RF and DC voltage sources communicating with the first electrodes 538 and second electrodes 540, and also a DC voltage source communicating with the third electrode(s) 550 and fourth electrode(s) 554. The first electrodes 538 and second electrodes 540 may be configured for generating an RF or RF/DC ion confining field in the ion guide volume effective for confining ions along the guide axis. Moreover, as described further below, the effective potential (or pseudo-potential) of the RF or RF/DC field may include a series of alternating potential barriers and wells, or potential corrugations, which successively increase in magnitude in the axial direction toward the ion exit end 534 due to the converging geometry. In typical embodiments, the RF voltage source is configured for applying the RF potentials to the first electrodes 538 and second electrodes 540 such that axially adjacent electrode pairs 538/540 are out of phase with each other (typically by 180 degrees). In some embodiments, DC potentials are applied to the first electrodes 538 and second electrodes 540 so as to generate an axial DC gradient in the ion guide volume along the drift axis and thereby create a drag force on the ions to prevent stalling. In some embodiments, DC potentials are applied to the third electrode(s) 550 and fourth electrode(s) 554 to constrain the motions of ions along the transverse (x) axis and prevent their escape from the ion guide 500 along transverse (x-direction) trajectories. In some embodiments, DC potentials are applied to the third electrode(s) 550 and fourth electrode(s) 554 to generate an axial DC gradient. In further embodiments, RF potentials may be applied to the third electrode(s) 550 and fourth electrode(s) 554.

Figure 6:
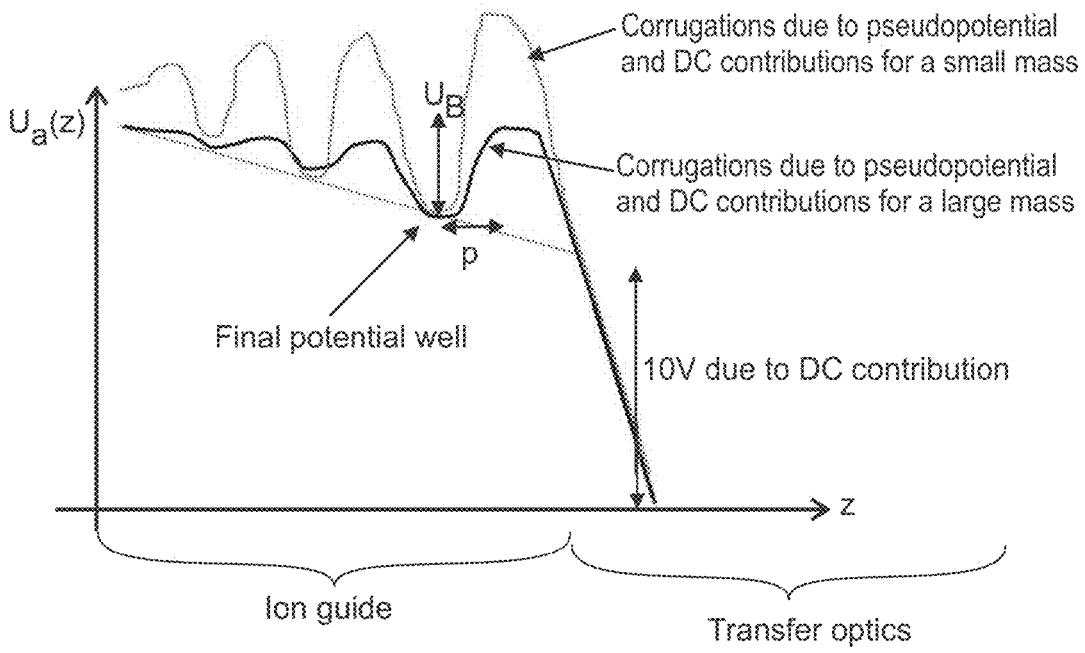
FIG. 6 is a plot of effective potential (in volts) as a function of axial position generated in an ion guide as disclosed herein.

FIG. 6 is a plot of effective potential (in volts) as a function of axial position generated in an ion guide as disclosed herein, such as the ion guide 400 or 500. The effective potential V* is directly proportional to the squared amplitude of the local RF field $E_{RF}$ (in volts/meter), inversely proportional to m/z ratio, and inversely proportional to the square of the RF drive frequency Ω. The local RF field $E_{RF}$ is dependent upon axial position along the drift (z) axis and transverse position (y) in the direction of the electrodes to which the RF potential is applied. As shown, because the effective potential V* is inversely mass-dependent, the magnitude of the potential corrugations are larger for smaller ion masses than for larger ion masses. As a result, upon transmitting a range of ion masses into the ion guide, ions become confined to separate, individual pseudo-potential wells according to their mass and in a manner which orders, or queues, the ions such that larger masses are confined closer to the ion exit end 534 while smaller masses are confined farther from the ion exit end 534. In FIG. 6, UB is the height of the final pseudo-potential barrier (or depth of the corresponding well) for a large mass, and p is the electrode pitch. The slanted line below the corrugations is the magnitude of the DC component of the composite field along the length of the ion guide. Also in this example, a constant DC potential of 10 V is applied to all of the electrodes to which the RF potentials are also applied.

The range of ion masses may be held in queue in the ion guide 400 or 500 in this manner for a desired period of time. An operating parameter of the RF field may then be scanned or swept in time in such a way as to release ions of larger mass first, followed by ions of lower mass, and to simultaneously shift even smaller masses ions closer to the ion exit end 534 as the scan proceeds. Typically, the operating parameter is the amplitude of the RF potential, $V_{RF}$, in which case scanning entails ramping down (decreasing) the RF amplitude over time. Alternatively, or additionally, the operating parameter may be the RF drive frequency Ω, in which case scanning entails ramping up (increasing) RF drive frequency over time. By this configuration, ions are released from the ion guide 400 or 500 in a pulsed manner and at different times according to their mass. Moreover, the larger (and thus slower) ion masses are released before the smaller (and thus faster) ion masses, allowing the later released smaller ion masses to eventually catch up to the larger ion masses downstream from the ion guide 400 or 500. The scanning of the operating parameter may be implemented according to a function (e.g., scan rate) that causes all (or substantially all) ion masses to arrive simultaneously at a desired focal point downstream from the ion guide 400 or 500. For example, the downstream focal point may be at or near the entrance to a mass analyzer or other ion processing device.

In a specific example, the downstream focal point may be inside the ion accelerator 262 of the TOF analyzer 216 shown in FIG. 2. FIG. 2 schematically illustrates the simultaneous arrival of low-mass ions 202, intermediate-mass ions 206, and high-mass ions 210 in the ion accelerator 262, at which point the ion accelerator 262 may apply a high voltage acceleration pulse to accelerate all of these ions into the flight tube simultaneously.

Figure 7:
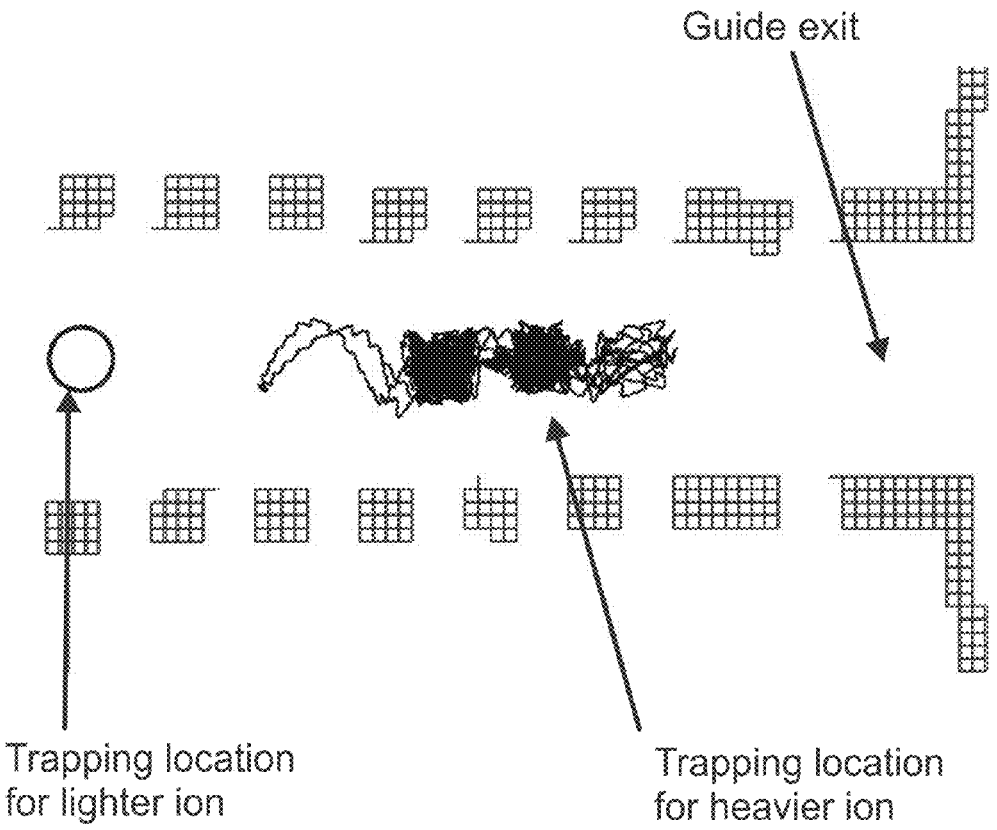
FIG. 7 is a side (lengthwise) view in the y-z plane of a simulated model of a pulsed ion guide with perpendicular geometry according to some embodiments.

FIG. 7 is a side (lengthwise) view in the y-z plane of a simulated model of a pulsed ion guide with perpendicular geometry, i.e., with electrodes perpendicular to the primary direction of ion travel, and an exit lens. FIG. 7 shows trapping locations for ions of different masses awaiting release from the ion guide. Mass-dependent trapping position is accomplished due to the mass-dependence of the RF repulsion from the electrodes near the exit.

Figure 8:
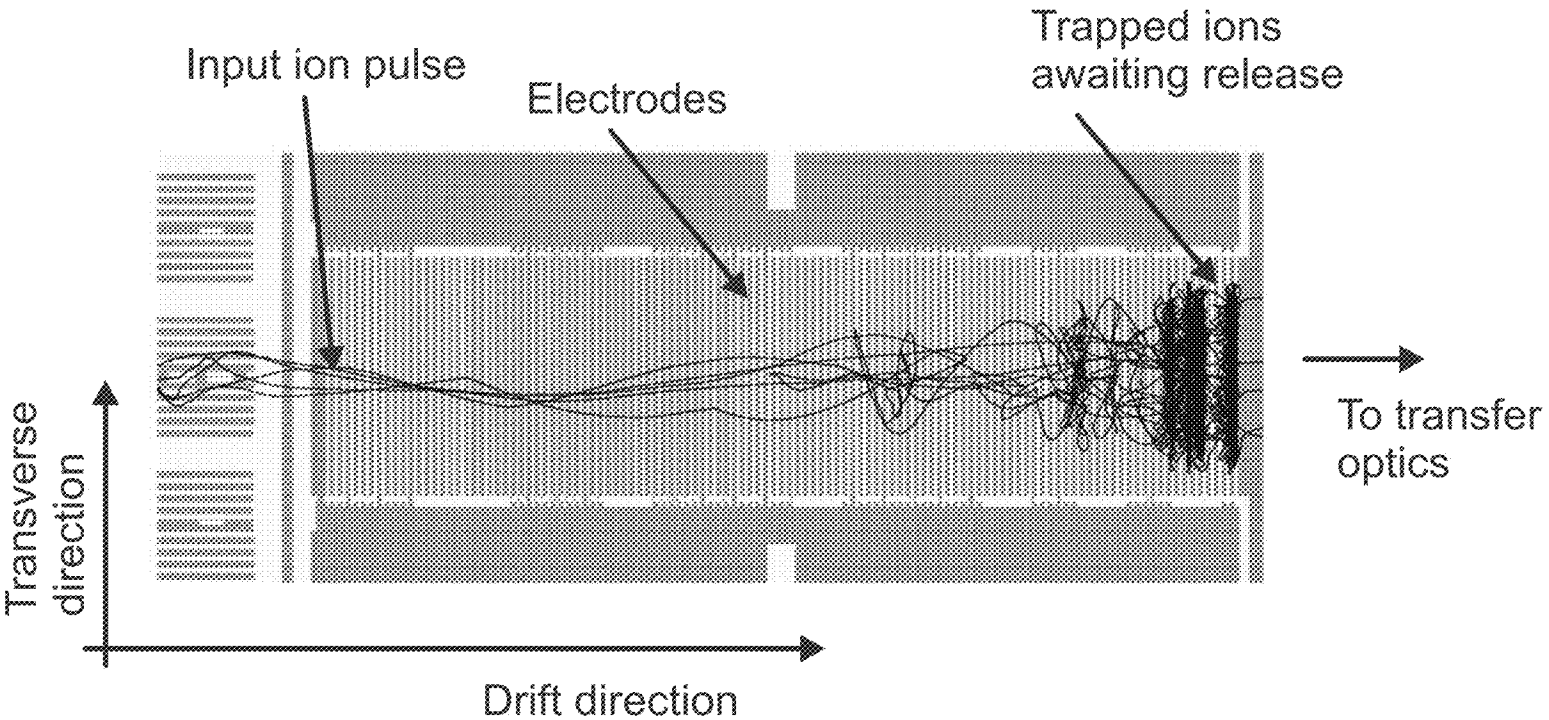
FIG. 8 is a side (lengthwise) view in the x-z plane of another simulated model of a pulsed ion guide with perpendicular geometry according to some embodiments.

FIG. 8 is a side (lengthwise) view in the x-z plane of another simulated model of a pulsed ion guide with perpendicular geometry. FIG. 8 shows the trajectories of ions transmitted into the pulsed ion guide from a multipole ion guide, and ions trapped near the guide exit awaiting release into transfer optics.

Figure 9:
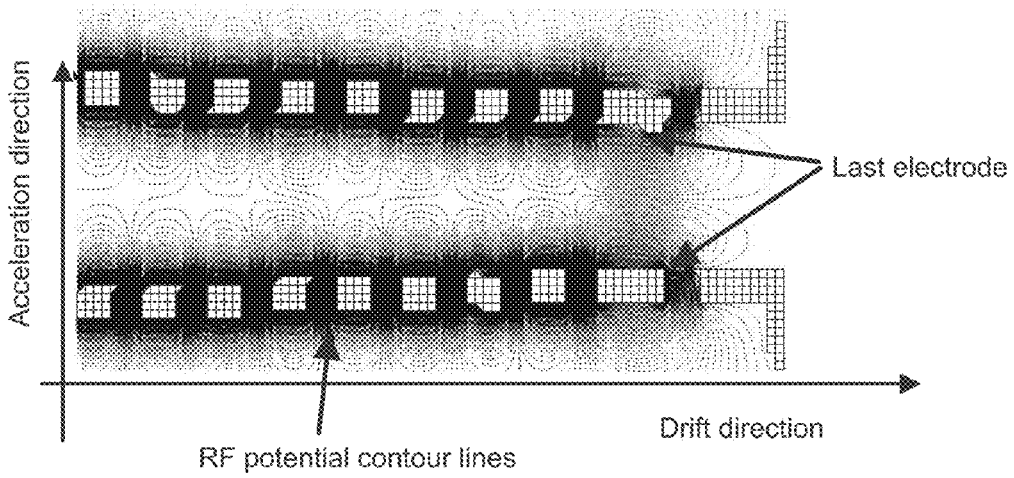
FIG. 9 is a side (lengthwise) view in the y-z plane of another simulated model of a pulsed ion guide with perpendicular geometry according to some embodiments.

FIG. 9 is a side (lengthwise) view in the y-z plane of another simulated model of a pulsed ion guide with perpendicular geometry, similar to FIG. 7. FIG. 9 shows the instantaneous potential contour lines for the RF potential. The line density on axis is related to the axial pseudo-potential. The RF phase between adjacent pairs of vertically aligned electrodes of the two substrates is opposite one another to maximize the axial electric field and pseudo-potential. FIG. 9 also shows an example of an embodiment in which the width of one or more of the electrodes differs from the width of the other electrodes. Specifically in FIG. 9, the last pair of electrodes (at the exit) is two to three times wider than the other electrodes.

In one specific yet non-limiting example of a pulsed ion guide, two 12-mm long planar substrates are patterned with 50-μm wide perpendicular electrodes (e.g., electrodes 304, FIGS. 3A and 3B) each separated by 50 μm. A main RF voltage is applied to these electrodes with alternating phases between adjacent electrodes. The last electrode is 150-μm wide (e.g., as shown in FIG. 9). The separation between the substrates along the acceleration (y) direction varies from 1 mm (1000 μm) at the guide entrance to 200 μm at the guide exit. The ion guide is 2 mm wide in the transverse (x) direction. To confine the ions in the transverse direction, two sidewalls (e.g., axially-oriented ion guide electrodes 312 and 314, FIG. 3A) are patterned onto each substrate and a repelling DC potential applied to them. The ion guide was evaluated for a time-of-flight mass spectrometer over a mass range of 100 amu to 3000 amu. The maximum flight time, equal to the accelerator pulse period, is 750 μs. The separation between the ion guide and the ion accelerator (e.g., ion accelerator 262, FIG. 2) is 290 mm along the drift (x) axis. The apertures (e.g., of the aperture pair 252, 254, FIG. 2) preceding the ion accelerator are each 0.9 mm wide along the acceleration (y) direction and 4 mm wide in the transverse (x) direction and separated by 90 mm along the drift (x) axis. The maximum RF amplitude is 100 V. The RF frequency is 50 MHz. A DC voltage difference of 0.5 V is applied between the entrance and exit to create a drag field along the drift direction.

The geometry of a pulsed ion guide as described herein, in which electrodes are oriented perpendicular to the primary direction of ion travel, scales favorably to ion guides with smaller dimensions. The perpendicular geometry has the advantage of simultaneously realizing brighter beams, smaller drift-direction ion energy spread, and smaller variation in the release time of a given ion mass. As described previously, a small spatial spread in ion location along the acceleration direction leads to a brighter beams and consequently higher aperture transmission. It is also advantageous to reduce the spatial width of the trapped ion cloud along the drift direction when maximizing the duty cycle and TOF transmission. Drift-direction kinetic energy spread and release time spread must both be minimized simultaneously.

In larger trap volumes, the transit time across the trap volume is longer and consequently the release time spread, or transit time spread, is longer. The pulse-width at a single mass (release time spread) could be reduced by raising the extraction electric field, however that increases the drift-direction energy spread. To reduce the time-spread and energy-spread simultaneously, it is advantageous to use a trap with small characteristic length scale along the drift direction, which is a particular advantage of the perpendicular geometry.

The perpendicular guide geometry scales favorably to the smaller ion volumes for multiple reasons. First, the pseudo-potential corrugations are localized to distance scales comparable to the electrode dimension along the drift and acceleration directions. Second, the electrode dimensions can be minimized in a practical manner by using patterned planar substrates fabricated with methods well-known in microfabrication.

In addition to the above advantages, the guide also reduces the deleterious effects of Coulomb repulsion between ions. By creating a series of pseudo-potential corrugations of increasing magnitude as the guide exit is approached, the mass-dependence of the pseudo-potential can be exploited to queue the ions by mass from light to heavy, with heavier ions closer to the exit. The increasing mass-dependent amplitude of the pseudo-potential corrugations means that ions awaiting release are spread out over a larger volume, thereby reducing the charge density and Coulomb force. In this way, the local charge density contributing to the electric field near the exit region will contain contributions from only a narrow range of masses rather than the entire mass range. To further reduce charge density and the associated electric field, the width of the ion cloud in the transverse (x) direction can be much wider than the width in the acceleration (y) direction.

Thus it is evident that a pulsed ion guide as described herein may improve ion transmission in an MS system, resulting in improved limits-of-detection, speed, mass accuracy, and mass resolution. In particular, a pulsed ion guide as described herein may simultaneously address the three different sources of ion loss (poor ion transmission efficiency) attending a TOF-MS system: poor ion transmission through apertures upstream of the ion pulsed accelerator, low duty cycle in the ion accelerator, and poor ion transmission in the flight tube to the ion detector due to angular divergence in the flight path.

An example of a method for operating a pulsed ion guide configured according to any of the above embodiments will now be described. For illustrative purposes, reference is made to the TOF-MS system 200 shown in FIG. 2. The pulsed ion guide 240 is cycled through two or three operational phases during the time between successive high-voltage pulses by the ion accelerator 262 of the TOF analyzer 216—specifically, a loading phase, an optional cooling phase, and a release phase. An RF field or composite RF/DC field is generated in the guide volume with a corrugated effective potential as described above. The loading phase may be initiated by lowering the voltage (e.g., a DC barrier potential) on an entrance lens to the ion guide 240 (e.g., interface lens 248) to allow ions to enter the ion guide 240. The loaded ions are radially confined and focused toward the drift axis, and become axially confined in potential wells in a mass-dependent order as described above. The loading phase is then terminated by raising that voltage to a sufficiently high level that blocks incoming ions. In some embodiments, the loaded ions may have first been accumulated in a multipole ion trap preceding the ion guide 240 (e.g., an ion trap 128 as shown in FIG. 1). The loading phase may then be followed by the cooling phase, during which the ions are trapped within the ion guide 240 and equilibrate with a buffer gas supplied to the guide volume. In some embodiments, the ion guide 240 operates at a gas pressure in a range, for example, from 5 to 50. In some embodiments the cooling phase may not be needed. For example, the loading phase may be long enough to cool the ions sufficiently and/or sufficient cooling may have already been implemented upstream of the ion guide 240. The RF voltage amplitude applied to the perpendicular electrodes is at its maximum value during the loading and cooling phases.

The release phase is characterized by ramping the applied RF voltage amplitude from its maximum to a minimum. The ramp may be such that the amplitude is reduced linearly in time. The ramp duration is the difference in transit times between the ion guide 240 and the ion accelerator 262 for the maximum and minimum masses which are blocked. When the RF amplitude is ramped linearly in time, the released mass as a function of time is such that all ions arrive in the ion accelerator 262 simultaneously, as shown in FIG. 2. As described above, the RF frequency may be ramped down alternatively or in addition to ramping up of the RF amplitude. In practice, however, it is often simpler to scan the RF amplitude.

Figure 10:
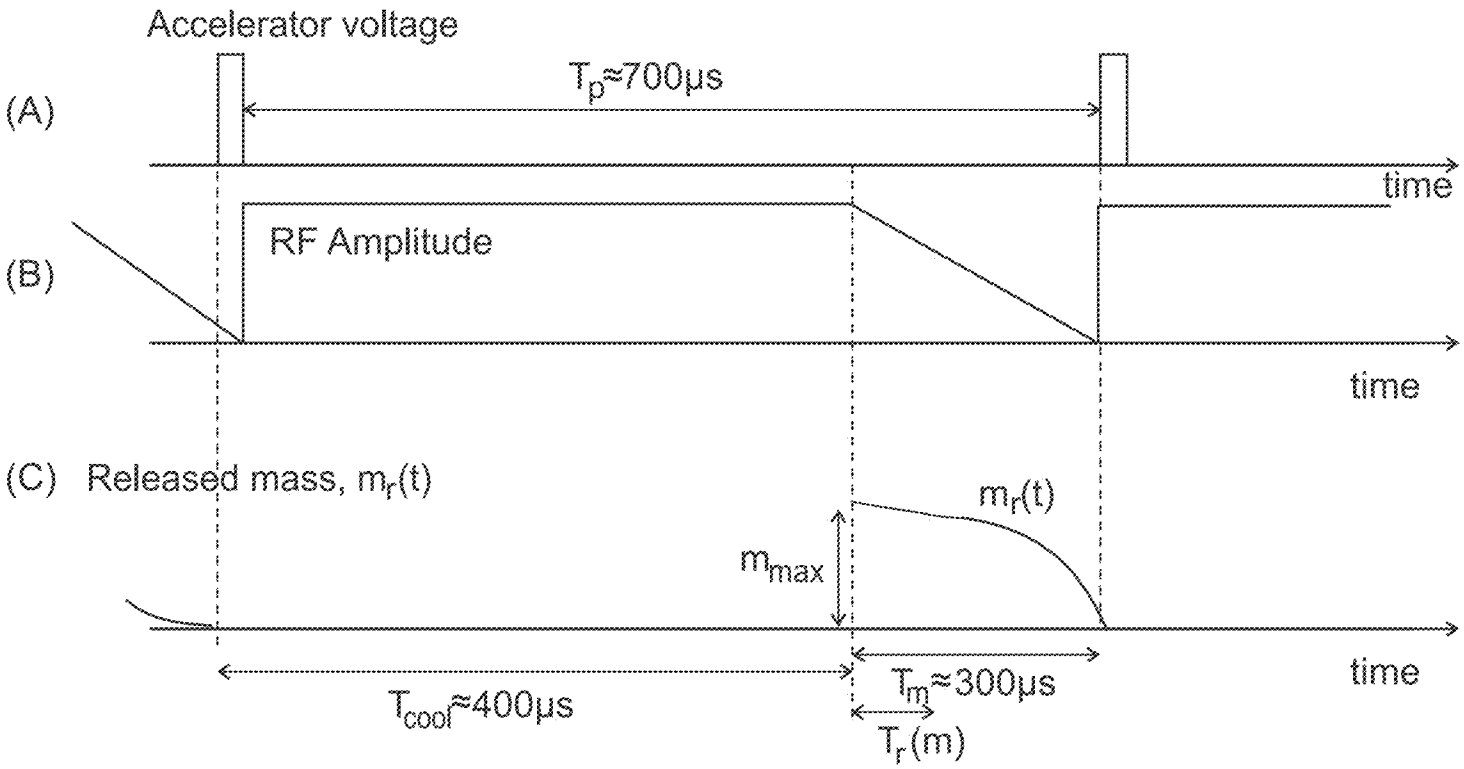
FIG. 10 is a timing diagram corresponding to the operation of a pulsed ion guide according to some embodiments.

FIG. 10 is a timing diagram corresponding to the present example of operating the ion guide 240. Specifically, FIG. 10 illustrates the pulsed accelerator voltage (sequence A), the RF amplitude (sequence B), and the value of the masses of ions released from the ion guide 240 as a function of time (sequence C). In this example, the period $T_p$ between accelerator pulses (sequence A) is about 700 μs. The release phase is attended by a scanning operation, which in this example is a linear ramp-down in the RF amplitude (sequence B). The loading phase is typically of short duration (e.g., 50 μs) and although not specifically shown, occurs at the beginning of the cooling phase, which in the present example transpires over a period $T_{cool}$ of about 400 μs (sequence C). The release phase transpires over a period $T_m$ of about 300 μs (sequence C). The curve associated with the release phase designates the value $m_r(t)$ of the ion mass being release at time t, beginning with the largest mass in the spectrum, $m_{max}$, and followed by successively smaller masses as described above. The period $T_r(m)$ corresponds to the release time of a given ion mass, which is mass-dependent.

In various embodiments of the pulsed ion guide, other variations may be implemented to realize desired attributes such as beam brightness, small energy spread, and simultaneous ion arrival. As one example and as noted above, the electrode width and separation (pitch) may be varied along the length of the ion guide to tailor the width and depth of the axial pseudopotential corrugations. Additionally, the RF and/or DC voltages may vary along the ion guide to optimize the RF and/or DC components of the electric field as desired. Auxiliary RF voltages of the same or different amplitude and/or frequency as the main RF voltage may be applied to selected electrodes, such as near the exit or between two opposing substrates. Multiple RF fields may allow the independent optimization of the mass queuing effect and the release time spread. Similarly, the DC voltage difference applied to selected electrodes near the guide exit may be different from the DC voltages applied to the entrance of the guide, allowing the electrostatic and pseudopotential contributions to the total potential to vary together.

Certain embodiments of a pulsed ion guide have been described herein primarily in the context of use in conjunction with a TOF analyzer. It will be understood, however, that a pulsed ion guide as described herein may be utilized as an ion guide or ion trap in conjunction with other types of MS instruments and systems. Moreover, as noted above the pulsed ion guide itself may be utilized as a mass analyzer with the ion detector positioned close to the guide exit, which for many applications may offer a viable, less expensive alternative to conventional mass analyzers. The pulsed ion guide has general applicability in a wide range of ion manipulating systems and in a wide range of operating conditions, including either high-vacuum environments or higher-pressure environments involving a significant presence of buffer gas.

Exemplary Embodiments

Exemplary embodiments provided in accordance with the presently disclosed subject matter include, but are not limited to, the following:

1. An ion guide, comprising: an entrance end; an exit end spaced from the entrance end along a drift axis, wherein the ion guide has a guide length from the entrance end to the exit end; a plurality of electrodes axially spaced along the guide length, each electrode elongated along a transverse direction orthogonal to the drift axis, wherein the electrodes at least partially define a guide volume from the entrance end to the exit end; and a voltage source communicating with the electrodes and configured for: generating a radio frequency (RF) field in the guide volume effective for confining ions along the guide axis, and comprising a series of potential corrugations that successively increase in magnitude in a direction toward the exit end; and scanning an operating parameter of the RF field.

2. The ion guide of embodiment 1, wherein the plurality of electrodes comprises: a plurality of first electrodes axially spaced along the guide length, each first electrode elongated along a first transverse direction orthogonal to the drift axis; and a plurality of second electrodes axially spaced along the guide length, each second electrode elongated along the first transverse direction, wherein each first electrode is spaced at a distance from a corresponding second electrode along a second transverse direction orthogonal to the first transverse direction and to the drift axis.

3. The ion guide of embodiment 2, wherein, over at least a portion of the guide length, the distance between each first electrode and corresponding second electrode successively decreases in a direction toward the exit end, such that the exit end is smaller than the entrance end in the second transverse direction.

4. The ion guide of embodiment 2 or 3, wherein each first electrode and corresponding second electrode at a distance thereto forms an electrode pair, and the voltage source is configured for applying an RF voltage to each electrode pair such that axially adjacent electrode pairs are out of phase with each other.

5. The ion guide of embodiment 4, wherein the voltage source is configured for applying a direct current (DC) voltage to the electrode pairs.

6. The ion guide of embodiment 5, wherein the voltage source is configured for applying the DC voltage so as to generate an axial DC gradient along the drift axis.

7. The ion guide of any of embodiments 2 to 6, comprising a third electrode and a fourth electrode extending along the drift axis and spaced from each other along the first transverse direction at opposing sides of the first electrodes and the second electrodes.

8. The ion guide of embodiment 7, wherein the third electrode comprises a plurality of third electrodes axially spaced along the guide length, and the fourth electrode comprises a plurality of fourth electrodes axially spaced along the guide length.

9. The ion guide of embodiment 7 or 8, wherein the third electrode comprises an upper third electrode and a lower third electrode spaced from each other along the second transverse direction, and the fourth electrode comprises an upper fourth electrode and a lower fourth electrode spaced from each other along the second transverse direction.

10. The ion guide of any of embodiments 7 to 9, comprising a first substrate and a second substrate, wherein the first electrodes and the third electrode are disposed on the first substrate, and the second electrodes and the fourth electrode are disposed on the second substrate.

11. The ion guide of embodiment 7 or 8, wherein the third electrode and the fourth electrode each extend along the second transverse direction between the first electrodes and the second electrodes.

12. The ion guide of embodiment 11, comprising a first substrate, a second substrate, a third substrate, and a fourth substrate, wherein the first electrodes are disposed on the first substrate, the second electrodes are disposed on the second substrate, the third electrode is disposed on the third substrate, and the fourth electrode is disposed on the fourth substrate.

13. The ion guide of any of embodiments 7 to 12, wherein the voltage source is configured for applying a direct current (DC) voltage, or both a DC voltage and an RF voltage, to the third electrode and the fourth electrode.

14. The ion guide of embodiment 13, wherein the DC voltage is effective for repelling ions along the first transverse direction toward the drift axis, or for generating an axial DC gradient along the drift axis, or both of the foregoing.

15. The ion guide of any of the preceding embodiments, wherein the electrodes are arranged such that a dimension of the guide volume tapers over at least a portion of the guide length, and the exit end is smaller than the entrance end.

16. The ion guide of any of the preceding embodiments, wherein the voltage source is configured for scanning the operating parameter by ramping down an amplitude of the RF field, ramping up a frequency of the RF field, or both of the foregoing.

17. The ion guide of embodiment 16, wherein the voltage source is configured for scanning the operating parameter by scanning a magnitude of a direct current (DC) potential applied to at least some of the electrodes.

18. The ion guide of any of the preceding embodiments, wherein the voltage source is configured for applying a main RF voltage to the electrodes to generate the RF field, and an auxiliary RF voltage to one or more selected electrodes.

19. The ion guide of any of the preceding embodiments, wherein the voltage source is configured for applying a direct current (DC) potential to at least some of the electrodes effective for repelling ions toward the drift axis, or for generating an axial DC gradient along the drift axis, or both of the foregoing.

20. The ion guide of embodiment 19, wherein the voltage source is configured for scanning a magnitude of the DC potential.

21. The ion guide of any of the preceding embodiments, wherein the voltage source is configured for applying DC potentials of different magnitudes to selected electrodes.

22. The ion guide of any of the preceding embodiments, wherein the electrodes have respective widths along the drift axis and a configuration selected from the group consisting of: each width is in a range from 5 to 500 μm; the width of at least one electrode is different from the widths of the other electrodes; the width of electrode nearest to the exit end is greater than the widths of the other electrodes; and a combination of two or more of the foregoing.

23. The ion guide of any of the preceding embodiments, wherein each electrode has a length along the transverse direction in a range from 500 to 5000 μm.

24. The ion guide of any of the preceding embodiments, wherein respective pairs of adjacent electrodes are separated by a pitch along the drift axis and have a configuration selected from the group consisting of: each pitch is in a range from 5 to 1000 μm; the pitch between at least one pair of adjacent electrodes is different from the pitches of the other electrodes; and both of the foregoing.

25. The ion guide of any of the preceding embodiments, wherein the guide volume has a polygonal or rectilinear cross-section from the entrance end to the exit end.

26. The ion guide of any of the preceding embodiments, comprising a first substrate and a second substrate opposing the first substrate, wherein each electrode is disposed on either the first substrate or the second substrate.

27. The ion guide of any of the preceding embodiments, comprising a first substrate, a second substrate opposing the first substrate, a third substrate orthogonal to the first substrate and the second substrate, and a fourth substrate opposing the third substrate, wherein each substrate includes at least one of electrodes disposed thereon.

28. The ion guide of embodiment 27, wherein the voltage source is configured for applying RF potentials to the electrodes disposed on the first substrate and the second substrate, and direct current (DC) potentials to the electrodes disposed on the third substrate and the fourth substrate.

29. The ion guide of embodiment 28, wherein the voltage source is configured for applying additional potentials selected from the group consisting of: DC potentials to the electrodes disposed on the first substrate and the second substrate; RF potentials to the electrodes disposed on the third substrate and the fourth substrate; or both of the foregoing.

30. A mass spectrometer (MS), comprising: the ion guide of any of the preceding embodiments; and an ion detector downstream from the ion guide.

31. The MS of embodiment 30, comprising at least two ion lenses spaced apart from each other along the drift axis between the ion guide and the mass analyzer.

32. The MS of embodiment 31, wherein at least one of the ion lenses is an ion slicer.

33. The MS of any of embodiments 30 to 32, comprising a mass analyzer between the ion guide and the ion detector.

34. The MS of embodiment 33, wherein the mass analyzer is a time-of-flight analyzer.

35. The MS of embodiment 34, wherein the transverse direction along which the electrodes of the ion guide are elongated is a first transverse direction, and the time-of-flight analyzer comprises an ion accelerator configured for receiving ions along the drift axis and accelerating the ions along a second transverse direction orthogonal to the first transverse direction and to the drift axis.

36. The MS of embodiment 35, wherein the ion detector is spaced from the ion accelerator along the drift axis, and the time-of-flight analyzer comprises an ion mirror spaced from the ion accelerator and from the ion detector along the second transverse direction, such that the time-of-flight analyzer defines an ion flight path from the ion accelerator to the ion mirror, and from the ion mirror to the ion detector.

37. The MS of any of embodiments 30 to 36, comprising an ion source upstream of the ion guide.

38. A method for guiding ions, the method comprising: transmitting ions through an ion guide comprising an entrance end, an exit end spaced from the entrance end along a drift axis, and a plurality of electrodes at least partially defining a guide volume from the entrance end to the exit end; while transmitting the ions, applying a radio frequency (RF) voltage to the electrodes to generate an RF field in the guide volume comprising a series of potential corrugations that successively increase in magnitude in a direction toward the exit end, wherein the RF voltage has an amplitude effective for trapping the ions in the corrugations in order of mass-to-charge (m/z) ratio that increases in the direction of the exit end, such that ions of higher m/z ratio are trapped closer to the exit end; and sequentially releasing the ions through the exit end in order of higher m/z ratio to lower m/z ratio by scanning an operating parameter of the RF voltage.

39. The method of embodiment 38, wherein scanning the operating parameter comprises ramping down an amplitude of the RF voltage, ramping up a frequency of the RF voltage, or both of the foregoing.

40. The method of embodiment 39, wherein scanning the operating parameter comprises scanning a magnitude of a direct current (DC) potential applied to at least some of the electrodes.

41. The method of embodiment 38 or 39, comprising scanning the operating parameter according to a function that causes substantially all of the released ions to arrive at a downstream focal point at the same time.

42. The method of embodiment 41, wherein the focal point is at or near an entrance to a mass analyzer, or in an ion accelerator of a time-of-flight analyzer.

43. The method of any of embodiments 38 to 42, wherein the RF field comprises a main RF field and an auxiliary RF field superimposed on the main RF field in at least a portion of the ion guide.

44. The method of any of embodiments 38 to 43, comprising generating a direct current (DC) field in at least a portion of the ion guide effective for repelling ions toward the drift axis, or for generating an axial DC gradient along the drift axis, or both of the foregoing.

45. The method of embodiment 44, comprising scanning a magnitude of the DC potential.

46. The ion guide of embodiment 44 or 45, comprising applying DC potentials of different magnitudes to selected electrodes.

47. The method of any of embodiments 38 to 46, wherein the electrodes are axially spaced from the entrance end to the exit end, and each electrode is elongated along a transverse direction orthogonal to the drift axis.

48. The method of any of embodiments 38 to 47, wherein the electrodes are arranged such that a dimension of the guide volume tapers over at least a portion of the guide length, and the exit end is smaller than the entrance end.

49. A mass spectrometry system configured for performing the method of any of the preceding embodiments.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion guide, comprising:

an entrance end;

an exit end spaced from the entrance end along a drift axis, wherein the ion guide has a guide length from the entrance end to the exit end;

a plurality of electrodes axially spaced along the guide length, each electrode elongated along a transverse direction orthogonal to the drift axis, wherein the electrodes at least partially define a guide volume from the entrance end to the exit end; and a voltage source communicating with the electrodes and configured to:

a) generate a radio frequency (RF) field in the guide volume effective for confining and trapping ions in the ion guide, and comprising a series of potential corrugations that successively increase in magnitude in a direction toward the exit end such that heavier ions are trapped inside the ion guide closer to an exit of the ion guide than where lighter ions are trapped inside the ion guide; and b) scan an operating parameter of the RF field to release the heavier ions first from the ion guide and sequentially thereafter to release the lighter ions such that the lighter ions catch up with the heavier ions downstream from the ion guide.

2. The ion guide of claim 1, wherein the plurality of electrodes comprises:

a plurality of first electrodes axially spaced along the guide length, each first electrode elongated along a first transverse direction orthogonal to the drift axis; and a plurality of second electrodes axially spaced along the guide length, each second electrode elongated along the first transverse direction, wherein each first electrode is spaced at a distance from a corresponding second electrode along a second transverse direction orthogonal to the first transverse direction and to the drift axis.

3. The ion guide of claim 2, comprising a first substrate and a second substrate opposing the first substrate, wherein the first electrodes are disposed on the first substrate and the second electrodes are disposed on the second substrate.

4. The ion guide of claim 2, wherein each first electrode and corresponding second electrode at a distance thereto forms an electrode pair, and the voltage source is configured to apply an RF voltage to each electrode pair such that axially adjacent electrode pairs are out of phase with each other.

5. The ion guide of claim 4, wherein the voltage source is configured to apply a direct current (DC) voltage to at least some of the electrode pairs, and the DC voltage is configured for generating an axial DC gradient along the drift axis, or repelling ions toward the drift axis, or both generating an axial DC gradient along the drift axis and repelling ions toward the drift axis.

6. The ion guide of claim 2, comprising a third electrode and a fourth electrode extending along the drift axis and spaced from each other along the first transverse direction at opposing sides of the first electrodes and the second electrodes.

7. The ion guide of claim 6, wherein the third electrode and the fourth electrode have a configuration selected from the group consisting of:

the third electrode comprises a plurality of third electrodes axially spaced along the guide length, and the fourth electrode comprises a plurality of fourth electrodes axially spaced along the guide length;

the third electrode comprises an upper third electrode and a lower third electrode spaced from each other along the second transverse direction, and the fourth electrode comprises an upper fourth electrode and a lower fourth electrode spaced from each other along the second transverse direction;

the ion guide comprises a first substrate and a second substrate, wherein the first electrodes and the third electrode are disposed on the first substrate, and the second electrodes and the fourth electrode are disposed on the second substrate;

the third electrode and the fourth electrode each extend along the second transverse direction between the first electrodes and the second electrodes; and the ion guide comprises a first substrate, a second substrate, a third substrate, and a fourth substrate, wherein the first electrodes are disposed on the first substrate, the second electrodes are disposed on the second substrate, the third electrode is disposed on the third substrate, and the fourth electrode is disposed on the fourth substrate.

8. The ion guide of claim 6, wherein the voltage source has a configuration selected from the group consisting of:

the voltage source is configured to apply a direct current (DC) voltage, or both a DC voltage and an RF voltage, to the third electrode and the fourth electrode; and the voltage source is configured to apply a direct current (DC) voltage to the third electrode and the fourth electrode, wherein the DC voltage is effective for repelling ions along the first transverse direction toward the drift axis, or for generating an axial DC gradient along the drift axis, or both of the foregoing.

9. The ion guide of claim 1, wherein the electrodes are arranged such that a dimension of the guide volume tapers over at least a portion of the guide length, and the exit end is smaller than the entrance end.

10. The ion guide of claim 1, wherein the voltage source is configured to scan the operating parameter according to an operation selected from the group consisting of: ramping down an amplitude of the RF field applied to at least some of the electrodes; ramping up a frequency of the RF field applied to at least some of the electrodes; scanning a magnitude of a direct current (DC) potential applied to at least some of the electrodes while applying the RF field; and a combination of two or more of the foregoing.

11. The ion guide of claim 1, wherein the voltage source is configured to apply a main RF voltage to the electrodes to generate the RF field, and an auxiliary RF voltage to one or more selected electrodes.

12. The ion guide of claim 1, wherein the voltage source is configured to apply a direct current (DC) potential to at least some of the electrodes, and the DC potential is selected from the group consisting of: a DC potential effective for repelling ions toward the drift axis; a DC potential effective for generating an axial DC gradient along the drift axis; a DC potential effective for ejecting ions through the exit end; a DC potential applied at different magnitudes to selected electrodes; and a combination of two or more of the foregoing.

13. The ion guide of claim 1, wherein the electrodes have respective widths along the drift axis and respective lengths along the transverse direction, and respective pairs of adjacent electrodes are separated by a pitch along the drift axis, and wherein the electrodes have a configuration selected from the group consisting of:

each width is in a range from 5 to 500 μm;

the width of at least one electrode is different from the widths of the other electrodes;

the width of electrode nearest to the exit end is greater than the widths of the other electrodes;

each length is in a range from 500 to 5000 μm;

each pitch is in a range from 5 to 1000 μm;

the pitch between at least one pair of adjacent electrodes is different from the pitches of the other electrodes; and a combination of two or more of the foregoing.

14. A mass spectrometer (MS), comprising:

the ion guide according to claim 1; and an ion detector downstream from the ion guide.

15. The MS of claim 14, comprising at least two ion lenses spaced apart from each other along the drift axis between the ion guide and the mass analyzer.

16. The MS of claim 14, comprising a mass analyzer between the ion guide and the ion detector.

17. The MS of claim 16, wherein the mass analyzer is a time-of-flight analyzer.

18. The MS of claim 16, further comprising an ion accelerator which accelerates ions into the mass analyzer.

19. The MS of claim 18, further comprising a computing device which controls the ion guide such that the ion guide releases the heavier ions and the lighter ions in sequence whereby the heavier ions and the lighter ions arrive at the ion accelerator at substantially the same time.

20. The MS of claim 18, wherein the computing device controls the ion guide such that different mass ions trapped in the ion guide are released in such a manner that the different mass ions arrive at the ion accelerator in an ion pulse having a length smaller than a length of the ion accelerator.

* * * * *